US008286809B2

(12) United States Patent
Mestres Armengol et al.

(10) Patent No.: US 8,286,809 B2
(45) Date of Patent: Oct. 16, 2012

(54) SELF-EXPANDING FOLDING STRUCTURE FOR A DISPLAY

(76) Inventors: Ferran Mestres Armengol, Barcelona (ES); Francisco López Fernandez, Barcelona (ES)

( * ) Notice: Subject to any disclaimer, the term of this patent is extended or adjusted under 35 U.S.C. 154(b) by 294 days.

(21) Appl. No.: 12/724,228

(22) Filed: Mar. 15, 2010

(65) Prior Publication Data

US 2011/0226717 A1 Sep. 22, 2011

Related U.S. Application Data

(63) Continuation-in-part of application No. PCT/ES2008/000593, filed on Sep. 16, 2008.

(30) Foreign Application Priority Data

Sep. 17, 2007 (ES) ..... 200702460

(51) Int. Cl.
*A47F 5/08* (2006.01)
*A47G 29/00* (2006.01)

(52) U.S. Cl. ..... 211/149; 211/135; 211/73

(58) Field of Classification Search ..... 211/72, 211/73, 149, 195, 135, 71.01, 183; 206/45.25, 206/175, 176, 193, 362.4, 395, 784, 750, 206/525.1; 248/152, 154, 174, 300
See application file for complete search history.

(56) References Cited

U.S. PATENT DOCUMENTS 2,677,469 A * 5/1954 Ludwig ..... 211/73
2,940,710 A * 6/1960 Adams ..... 248/174
3,836,104 A * 9/1974 Miller et al. ..... 248/150
4,271,766 A 6/1981 Schmiedeler
4,493,424 A 1/1985 Smith
4,570,805 A 2/1986 Smith
4,582,003 A 4/1986 Valero
4,632,345 A * 12/1986 Barley ..... 248/174
4,723,664 A 2/1988 Smith
5,193,466 A 3/1993 Eder
5,213,220 A * 5/1993 McBride ..... 211/132.1
5,315,936 A * 5/1994 Smith ..... 108/165
5,366,100 A 11/1994 Maglione
5,868,367 A * 2/1999 Smith ..... 248/174
6,098,820 A * 8/2000 Smith ..... 211/132.1
(Continued)

FOREIGN PATENT DOCUMENTS

DE 2714758 A1 10/1978
(Continued)

*Primary Examiner* — Jennifer E. Novosad
(74) *Attorney, Agent, or Firm* — Hess Patent Law Firm PC; Robert J. Hess

(57) ABSTRACT

A self-expanding foldable structure for a display has a structure that includes a pair of side walls (2) hinged at respective connection edges (2*a*) to opposing edges of a back wall (1) and a shelf (3) linked to the back and side walls (1, 2) such that they can adopt a flat position in which the back wall, side walls and shelf (1, 2, 3) are substantially coplanar and an expanded position in which the back wall, side walls and shelf (1, 2, 3) form respective dihedrons. An elastic element is arranged to push the structure to the expanded position. The side walls (2) comprise a transverse fold line (14) having one or more scored sections (14*a*) wherein an inner structure of the wall material is crushed, in combination with one or more cut sections (14*b*) wherein said inner structure of the wall material has flat edges that can mutually face and support one another in the expanded position.

19 Claims, 13 Drawing Sheets

U.S. PATENT DOCUMENTS

| | | | | |
|---|---|---|---|---|
| 6,347,772 | B1 * | 2/2002 | L'Hotel | 248/174 |
| 6,394,290 | B1 | 5/2002 | Walsh | |
| 6,612,669 | B2 * | 9/2003 | Grueneberg | 312/259 |
| 7,007,615 | B2 | 3/2006 | Grueneberg | |
| 7,070,057 | B2 * | 7/2006 | Moss et al. | 211/132.1 |
| 7,159,350 | B2 * | 1/2007 | L'Hotel | 40/610 |
| 7,896,172 | B1 * | 3/2011 | Hester | 211/59.3 |
| 8,136,678 | B2 * | 3/2012 | Moss | 211/73 |
| 2002/0190017 | A1 * | 12/2002 | Stevens | 211/118 |
| 2011/0011814 | A1 * | 1/2011 | Moss | 211/73 |

FOREIGN PATENT DOCUMENTS

| | | | |
|---|---|---|---|
| EP | 1640942 | A1 | 3/2006 |
| ES | 1008606 | U | 5/1989 |
| ES | 1063420 | U | 10/2006 |
| FR | 2683792 | A1 | 5/1993 |
| GB | 997755 | A | 7/1965 |
| GB | 2206434 | A | 1/1989 |
| GB | 2370977 | A | 7/2002 |
| JP | 2004049788 | A | 2/2004 |

* cited by examiner

SELF-EXPANDING FOLDING STRUCTURE FOR A DISPLAY

FIELD OF THE ART

The present invention generally relates to a self-expanding foldable structure for a display, and more particularly to an arrangement of panels of a relatively rigid material, such as cardboard, corrugated cardboard, plastic, corrugated plastic and foam board, among others, that can adopt a flat position, in which the panels are substantially coplanar, and an expanded position, in which the panels form respective trihedrons with one another, including at least one elastic element arranged to automatically push the structure towards the expanded position for the purpose of forming a display.

BACKGROUND OF THE INVENTION

Displays of corrugated cardboard or similar material provided with shelves that can bear and display products, for example, in a point of sale, are known in the prior art. Some of these displays comprise a structure formed from a single piece of relatively rigid sheet material with at least two vertical fold lines defining a back wall and two side walls that can be bent along said vertical fold lines in order to be arranged in mutually facing positions which are substantially perpendicular to said back wall, such that said structure can remain upright in an expanded working position. One or more shelves are hingedly joined to the back wall and can be arranged in a position substantially perpendicular to the back and side walls in said expanded position, and support means are arranged for bearing said third panel with respect to the first and second panels in the expanded position.

U.S. Pat. No. 4,271,766 describes a display with shelves of the type described above, in which the mentioned support means for the shelves comprise metal rods extending from another one of the side walls of the structure, and on which the front edges of the shelves rest. However, these metal rods must be manually installed and they prevent the capacity of the display for automatically standing up.

In U.S. Pat. No. 5,193,466 and U.S. Pat. No. 5,366,100, the side walls of the structure are folded inwardly and the support means comprise cords extending from another one of the side walls of the structure. These cords are loose in the flat position and substantially tensed in the expanded position to support the front edges of the shelves.

Patents JP-A-2004049788 and U.S. Pat. No. 7,007,615 disclose a display with shelves in which each shelf comprises a rigid shelf panel and an auxiliary panel provided with diagonal fold lines, acting as the support means for the shelf. The side walls of the structure fold inwardly, the shelf panel folds upwardly with respect to its back edge and the auxiliary panel, which is fixed at its ends to the side walls of the structure and at a central part to the lower part of the shelf panel, folds by bending along the diagonal fold lines.

In some of these known displays with shelves, for example those described in U.S. Pat. No. 4,493,424 and U.S. Pat. No. 6,394,290, the piece of sheet material furthermore includes a horizontal fold line transverse to the vertical fold lines to allow folding the display from an inactive flat position to a compact folded position. The display described in the mentioned U.S. Pat. No. 4,493,424 includes elastic pulling means, such as elastic rubber bands, for pulling on the side walls and applying them against the edges of the shelves to maintain the expanded position of the structure. These pulling means cooperate with a manual action in the standing of the display from the compact folded position to the expanded working position. When displays of this type are in their expanded working position, the shelves are supported on the back wall and, especially, on the side walls of the structure, so the weight of the products supported on the shelves is withstood by the piece of sheet material forming the structure. For this reason, when corrugated cardboard or plastic of considerable thickness is used to build the structure, the inner flutes thereof are arranged parallel to the vertical direction, since this is the direction in which such flutes offer greater structural strength. The side walls are often formed, in at least part of their horizontal extension, by a double or triple ply of corrugated cardboard or plastic to provide the structure with greater strength. These additional plies are typically adhered to the side walls. In some of the mentioned displays, the additional plies of the side walls are formed entirely with the piece of sheet material of the structure from extensions of the side walls bent along vertical fold lines, whereby also achieving that the side walls have smooth front edges, thus preventing the inner structure of the relatively rigid sheet material from being exposed along unappealing cut front edges of the panel of corrugated cardboard or plastic or other relatively rigid sheet material used.

A problem existing in displays with shelves of the prior art provided with horizontal fold lines formed by scored lines is that these scored lines crush the inner structure of the relatively rigid sheet material, weakening their bearing capacity in the vertical direction. Furthermore, the subsequently bending of the relatively rigid sheet material around the mentioned scored lines further weakens the bearing capacity of the structure. When the material used is corrugated cardboard or plastic, the horizontal fold lines crush the flutes of the corrugated cardboard or plastic in a direction transverse to the longitudinal direction thereof, so the continuity of the flutes is destroyed in horizontal fold lines and the vertical bearing capacity of the panel of structure is seriously weakened. Furthermore, when there are sections of the panel having a structure with two or more plies, due to the differences in the radii of curvature between the innermost plies and the outermost plies, bending them along horizontal fold lines formed by scored lines is virtually impossible without crushing, breaks and/or tears occurring in the corrugated cardboard or plastic or other relatively rigid sheet material. These problems are substantially the same in the case of using foam board or another similar material, although it does not have a predominant strength direction.

The mentioned U.S. Pat. No. 5,193,466 describes a product display with shelves comprising a structure formed by a panel having a structure of corrugated cardboard with vertical fold lines delimiting a single ply back wall and two triple ply side walls. The display folds along a horizontal fold line affecting only the back wall, and it prevents the folding problems in the triple ply side walls by providing cuts which divide the side walls into two parts; an upper part and a lower part. In order to couple the upper and lower parts of each side wall, a flange projects from the intermediate ply of the upper part that is configured to fit into a recess formed in the intermediate ply of the lower part. This solution preserves the structural continuity of the flutes of the corrugated cardboard in the side walls, and thereby the structural bearing capacity in the vertical direction. However, this solution requires manual assembly of the display to stand it up in its expanded position, and it is incompatible with a display that can be stood up automatically in cooperation with pulling means included therein.

In addition, foldable structures for a display made up of several panels linked with one another such that they can adopt a flat position, in which the panels are substantially coplanar, and an expanded position, in which the panels define a prism, such as a cube or a rectangular prism, are known on the market. However, these foldable structures for a display must be handled manually in order to go from the flat position to the expanded position, since they cannot be stood up automatically to the expanded position.

DISCLOSURE OF THE INVENTION

A self-expanding foldable structure for a display, comprising a first panel, a pair of second panels and a third panel, in which the mentioned second panels are hingedly joined at respective connection edges to opposing edges of said first panel. The first and second panels can be arranged in a flat position, in which the first and second panels are substantially coplanar, and an expanded position, in which the first and second panels form respective dihedrons with one another. The mentioned third panel is linked to at least one of the first and second panels and can be arranged substantially coplanar with the first and second panels in the flat position and between said second panels forming respective dihedrons therewith in the expanded position. The structure incorporates support means for bearing said third panel with respect to the first and second panels in the expanded position, and at least one elastic element to push the structure towards the expanded position.

The mentioned support means comprise, for each end of the third panel adjacent to one of the second panels, a link panel having first and second edges forming an acute angle with one another, and wherein said first edge of the link panel is hingedly joined to the corresponding edge of said opposing edges of the third panel and said second edge of the link panel is hingedly joined to an inner face of the corresponding second panel in an inclined position forming an angle with the connection edge of the corresponding second panel. Preferably, the first and second edges of the link panel, or the imaginary prolongations thereof, converge in a vertex located in the connection edge of the corresponding second panel.

Optionally, each link panel can be divided into two portions by an additional fold line, such that the two portions are arranged at least partially superimposed in the flat position and one after the other in the expanded position.

According to the present invention, the first panel of the self-expanding foldable structure is a back wall, the second panels are side walls and said third panel is a shelf of a self-expanding foldable display rack. The shelf is connected to at least the side walls by support means, for example a pair of link panels such as those described above. Said back and side walls comprise at least one transverse fold line perpendicular to said connection edges, thereby the back and side walls can be folded from said flat position to a compact folded position. Said transverse fold line comprises, at least in said two side walls, one or more scored sections, in which an inner structure of said relatively rigid material is crushed, in combination with one or more cut sections in which said inner structure of the relatively rigid material is not crushed and has flat edges that can mutually face and support one another when the display is in the expanded position.

In an embodiment of the display rack, the back wall and the side walls are formed from a first sheet piece of a relatively rigid material selected from a group comprising cardboard, corrugated cardboard, plastic, corrugated plastic and foam board, among others, in which the hinges between the back wall and the side walls are vertical fold lines obtained, for example, by scoring or by small discontinuous cuts, whereas the shelf and the mentioned link panels are formed from a second sheet piece of a relatively rigid material selected from a group comprising cardboard, corrugated cardboard, plastic, corrugated plastic and foam board, among others, in which the hinges between said shelf and the link panels are also fold lines obtained by similar means. The first and/or second sheet pieces include flanges configured to be joined to the other one of the first and/or second sheet pieces, for example by adhesive, in the required sites. The display rack can obviously include, in addition to the mentioned shelf, other similar or different shelves such as, for example, a pedestal formed by a lower shelf, a base panel with a back edge hingedly joined to a lower edge of the back wall, and a front wall with upper and lower edges hingedly joined to front edges of said lower shelf and of said base panel, respectively.

The first sheet piece includes horizontal fold lines which allow folding the display rack from the flat position to a compact folded position. One or more elastic elements, for example in the form of elastic bands, are connected at the ends thereof to the side walls to push the self-expanding foldable structure towards its expanded position. The display rack is configured such that it can stand up automatically to the expanded position from the compact folded position by means of a simple initial manual actuation.

In another example which does not form part of the invention, the first panel of the self-expanding foldable structure is a first quadrilateral side wall, the second panels are first and second polygonal base walls, and the third panel is a second quadrilateral side wall which, together with a number of additional quadrilateral side walls, form a self-expanding foldable prismatic display. The mentioned first, second and additional quadrilateral side walls are hingedly joined together at respective opposing side edges. The first and second polygonal base walls are preferably equal to one another and define an irregular or regular polygon, such as a triangle, a quadrilateral, a pentagon, a hexagon, etc., and the total number of quadrilateral side walls including the first, second and additional quadrilateral side walls is equal to the number of sides of the first and second polygonal base walls. The first quadrilateral wall is connected to the polygonal base walls by a pair of link panels such as those described above.

In an embodiment of the prismatic display, the first and second polygonal base walls and the first, second and additional quadrilateral side walls are formed from a single sheet piece of a relatively rigid material, selected from a group comprising cardboard, corrugated cardboard, plastic, corrugated plastic and foam board, among others. In this single sheet piece, the hinges between the first quadrilateral side wall and the first and second polygonal base walls are fold lines, the first, second and additional quadrilateral side walls are arranged consecutively adjacent forming a band, with the hinges between them formed by fold lines, and in which the hinges between the second quadrilateral side wall and the link panels are fold lines. Flanges configured to be joined with other panels, for example by adhesive, in the required sites extend from some panels of the single sheet piece. One or more elastic elements such as elastic bands connected at the ends thereof, for example, to the first and second polygonal base panels push the prismatic display towards its expanded position. The structure includes an auxiliary retaining member, preferably made from an auxiliary sheet piece, which is configured to engage with the panels of the structure like a clip for the purpose of maintaining the structure in the flat position against the force of the elastic element. This auxiliary retaining member is separable and is only used for the storage and transport of the prismatic display.

BRIEF DESCRIPTION OF THE DRAWINGS

The previous and other features and advantages will be more fully understood from the following detailed description of exemplary embodiments with reference to the attached drawings, in which.

DETAILED DESCRIPTION OF EXEMPLARY EMBODIMENTS

Figure 1:
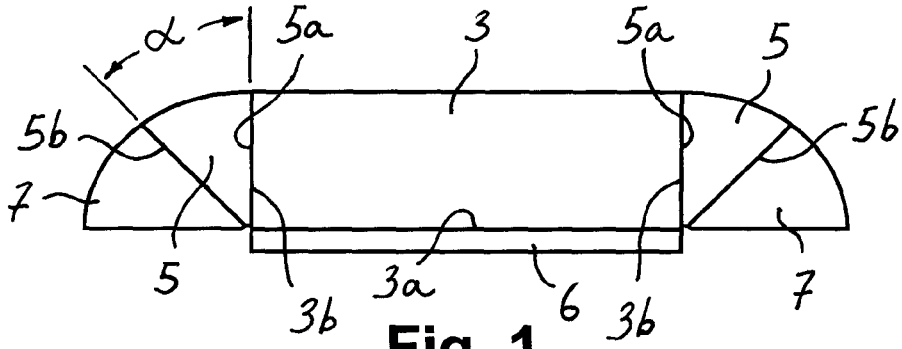
FIG. 1 is a schematic plan view showing some elements that can form part of a self-expanding foldable structure for a display according to the present invention.
Figure 2:
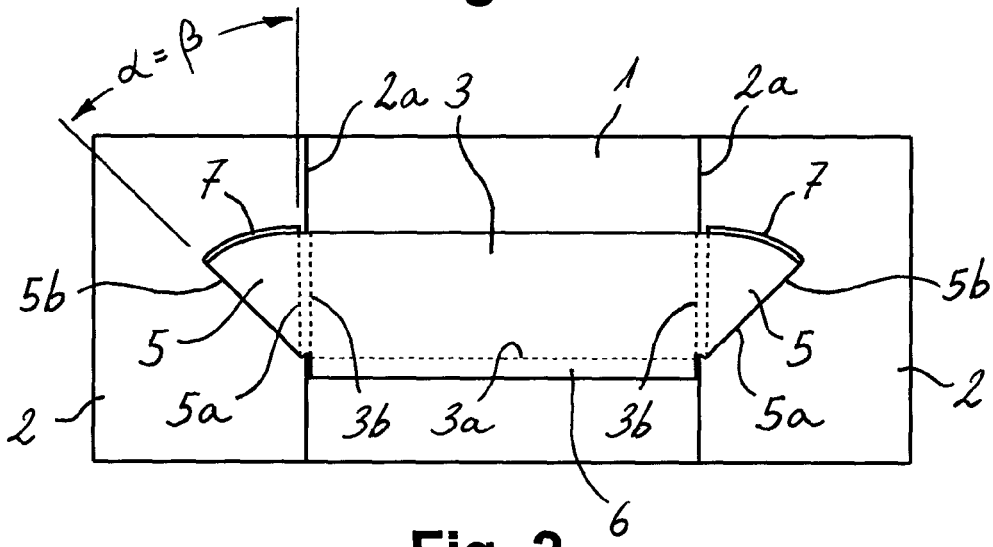
FIG. 2 is a schematic plan view showing the elements of FIG. 1 joined to other elements which form part of the self-expanding foldable structure for a display in a flat position.
Figure 3:
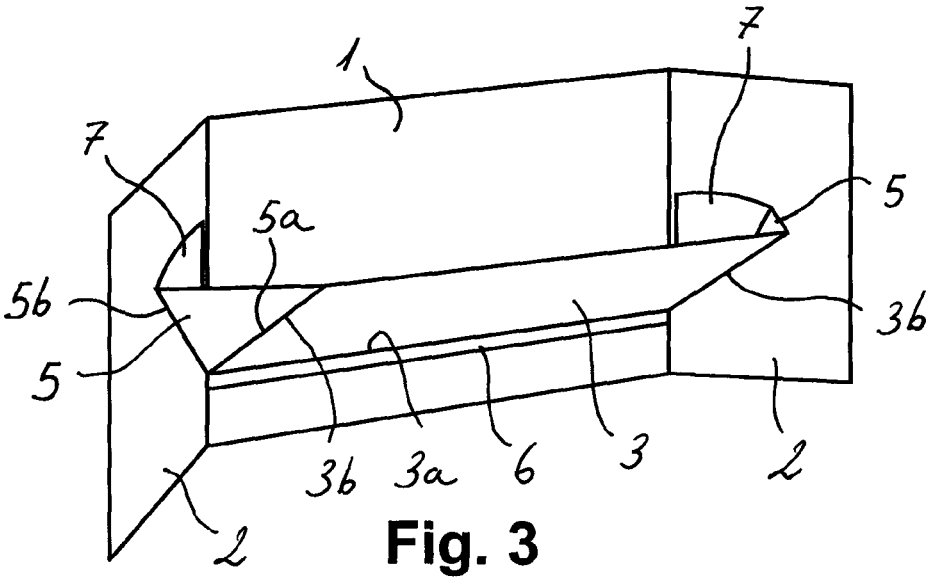
FIG. 3 is a schematic perspective view showing the main elements of FIG. 2 in a transition position between the flat position and an expanded position, or vice versa.
Figure 4:
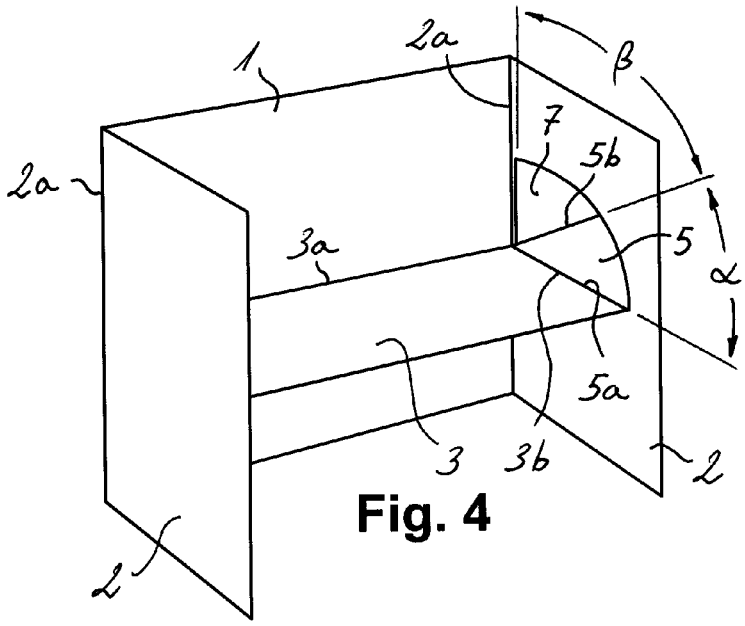
FIG. 4 is a schematic perspective view showing the main elements of FIG. 2 in the expanded position.

Referring first to FIGS. 1 to 4, some elements by means of which a self-expanding foldable structure for a display according to the present invention is formed are described below. The mentioned elements comprise a first panel 1, a pair of second panels 2, and a third panel 3. As is shown in FIG. 2, the two second panels 2 are hingedly joined at respective connection edges 2*a* to opposing edges of said first panel 1. Thus, the first panel 1 and the second panels 2 can be arranged in a flat position (FIG. 2), in which the first and second panels 1, 2 are substantially coplanar, and an expanded position (FIG. 4), in which the first and second panels 1, 2 form respective dihedrons with one another. The mentioned third panel 3 is linked to the first and second panels 1, 2 by hinged joints such that it can be arranged substantially coplanar with the first and second panels 1, 2 in the flat position (FIG. 2) and be arranged between said second panels 2 forming respective dihedrons therewith in the expanded position (FIG. 4). In the example shown in FIGS. 1 to 4, the third panel 3 has a first edge 3*a*, or back edge, hingedly joined to said back wall 1, and opposing end edges 3*b* linked to the second panels 2 by means of respective link panels 5, which furthermore form support means for bearing said third panel 3 forming respective dihedrons with the first and second panels 1, 2 in the expanded position.

Each of said link panels 5 has a substantially triangular shape, with first and second edges 5*a*, 5*b* forming an acute angle $\alpha$ with one another (FIGS. 1, 2 and 4). The third edge of the link panel can have any shape, for example, curved, as shown in FIGS. 1 to 4, straight, uneven or the like. The mentioned first edge 5*a* of each link panel 5 is hingedly joined to the corresponding end edge 3*b* of the third panel 3, whereas said second edge 5*b* of the link panel 5 is hingedly joined to an inner face of the corresponding second panel 2 in an inclined position, such that the second edge 5*b* of the link panel 5 forms an acute angle β with the connection edge 2*a* of the corresponding second panel 2, which forms a hinge line with the first panel 1 (FIGS. 2 and 4). When in the structure the second panels 2 form right dihedrons with the first panel 1 in the expanded position, the angles α and β are equal to one another and their sum is equal to the value of the dihedral angle formed between the third panel 3 and the first panel 1 in the expanded position. When the first, second and third panels 1, 2, 3 form respective right trihedrons with one another in the expanded position, angles α and β have a value of 45°. This is the case of the example shown in FIGS. 1 to 4, in which angles α and β are superimposed and coinciding in the flat position shown in FIG. 2.

In the example shown in FIGS. 1 to 4, the first and second edges 5*a*, 5*b* of the link panel 5 converge in a vertex located in the connection edge 2*a* of the corresponding second panel 2. However, it will be understood that the link panel could be truncated, in which case the imaginary prolongations of the first and second edges 5*a*, 5*b* thereof would converge in a vertex located in the connection edge 2*a* of the second panel 2. Likewise, if the third panel was rigid enough, the hinged connection of the first edge 3*a*, or back edge, of the third panel 3 with the back wall 1 could be omitted, and the first edge 3*a*, or back edge, of the third panel 3 could even be separated from the back wall 1 in the expanded position.

With this construction, the first, second and third panels 1, 2, 3 and the link panels 5 form a folding hinged panel structure that can go from the flat position shown in FIG. 2 to the expanded position shown in FIG. 4, going through the transition position shown in FIG. 3, or vice versa. In order for the structure of the present invention to furthermore be self-expanding, i.e., in order for it to go automatically from the flat position to the expanded position, the structure furthermore incorporates one or more elastic elements 4 (not shown in FIGS. 1 to 4) arranged to push the structure towards the expanded position, as will be seen below in the following embodiments. These one or more elastic elements 4 also serve to keep the structure in the expanded position, and a folding operation to take the structure from the expanded position to the flat position is carried out manually against the force of the elastic elements 4.

For practical purposes, the self-expanding foldable structure of FIGS. 1 to 4 can be formed, for example, from a first sheet piece incorporating the first panel 1 and the second panels 2 connected at fold lines, and a second sheet piece (shown separately in FIG. 1) incorporating the third panel 3, with a first joining flange 6 connected to the first edge 3*a*, or back edge, of the third panel 3 at a fold line, and the two link panels 5, with the first edge 5*a* of each link panel 5 connected to the corresponding end edge of the third panel 3 at a fold line and second joining flanges 7 connected to the second edges 5*b* of the link panels 5 at respective fold lines. In the embodiment shown, the second joining flanges 7 have a shape that is substantially symmetrical to that of the link panels 5 for aesthetic purposes, although it will be understood that they could have any other shape. In an operative position such as that shown in FIGS. 2 to 4, the mentioned first joining flange 6 is joined, for example, by adhesive, to an inner face of the back wall 1, and the second joining flanges 7 are joined, for example by adhesive, to the inner faces of the corresponding second panels 2. However, other constructive forms will occur to a person skilled in the art from other distributions of the panels in different sheet pieces, or even by means of a single sheet piece.

Figure 35:
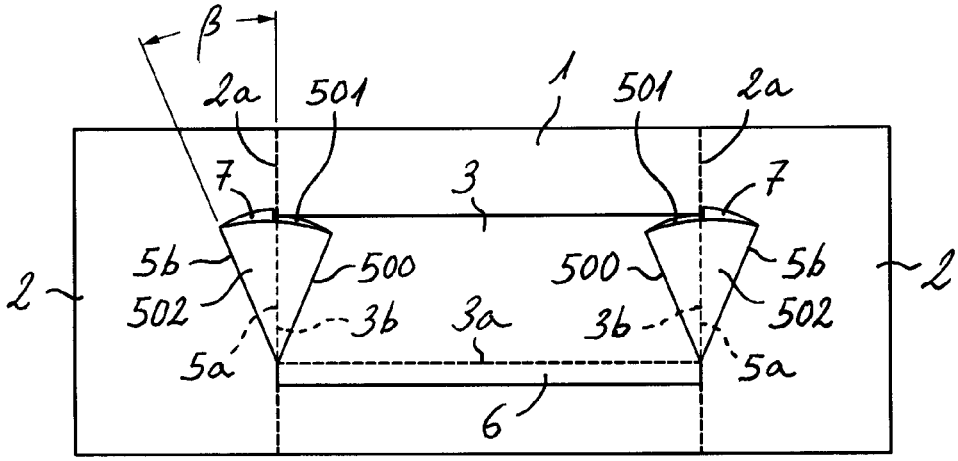
FIG. 35 is a schematic plan view showing the elements of FIG. 1 joined to other elements which complete the main elements of the self-expanding foldable structure for a display in a flat position.
Figure 36:
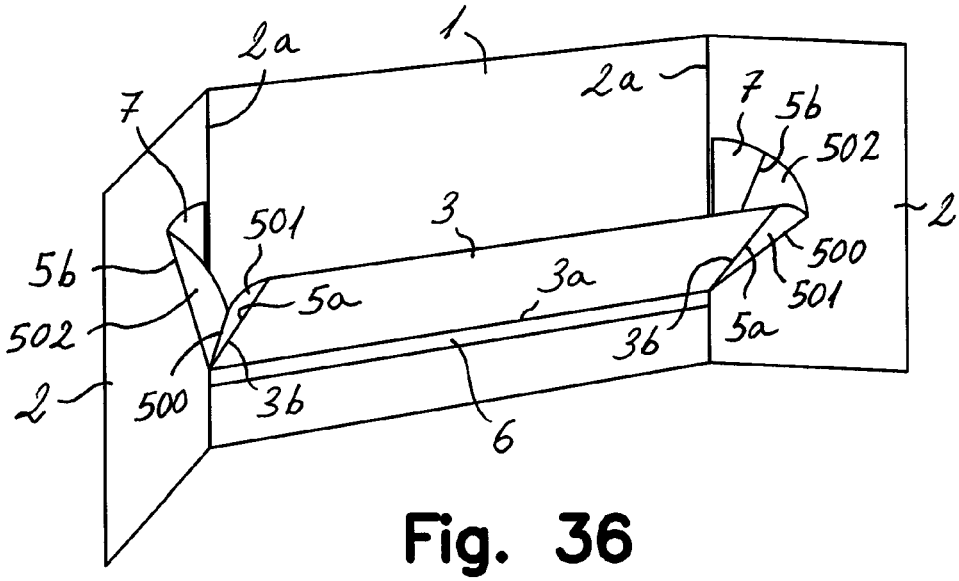
FIG. 36 is a schematic perspective view showing the main elements of FIG. 35 in a transition position between the flat position and an expanded position, or vice versa.
Figure 37:
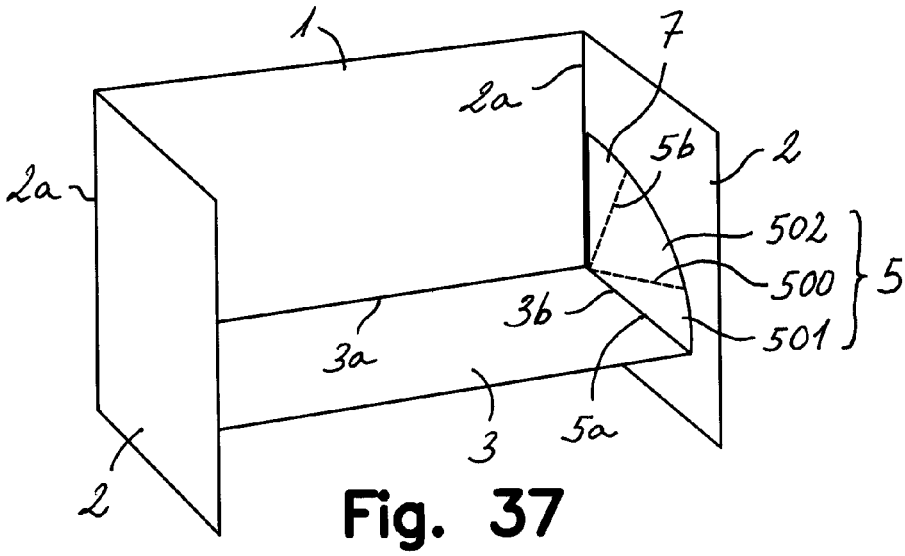
FIG. 37 is a schematic perspective view showing the main elements of FIG. 35 in the expanded position.

FIGS. 34 to 37 show an embodiment variant of the foldable structure, which only differs from the one described above in relation to FIGS. 1 to 4 in that each of the link panels 5 is divided into two portions 501, 502 by a fold line 500. FIG. 1 shows a first piece of sheet material incorporating the third panel 3 with the first joining flange 6 joined thereto at a fold line 3*a*, the two link panels 5 divided into the two portions 501, 502 by the fold line 500, and the two second joining flanges 7. Each link panel 5 here also has a first edge 5*a* hingedly joined to the corresponding end edge 3*b* of the third panel 3 and a second edge 5*b* hingedly joined to the corresponding second joining flange 7. The first and second edges 5*a*, 5*b* of each link panel 5 form an acute angle α with one another. FIGS. 35, 36 and 37 show said first piece of sheet material operatively assembled with a second piece of sheet material, which integrates the first panel 1 and the two second panels 2 hingedly joined with the first panel by means of, for example, respective connection edges 2*a*. The first and second edges 5*a*, 5*b* of each link panel 5, or the imaginary prolongations thereof, converge in a vertex on the corresponding connection edge 2*a*, and the fold line 500, or the imaginary prolongation thereof, likewise converges in said vertex. Each of the second joining flanges 6 of the first piece of sheet material is adhered to the corresponding second panel 2 of the second piece of sheet material, such that the second edge 5*b* of the corresponding link panel 5 forms an acute angle β with the connection edge 2*a* of the corresponding second panel 2.

With the assembly put together and in the flat position (FIG. 35), each link panel 5 is bent along the mentioned fold line 500 such that the two portions 501, 502 are partially superimposed. The link panels are preferably bent along the fold line 500 with the latter outwards, such that in the flat position shown in FIG. 35, the fold line 500, one of the two portions 501 and part of the other portion 502 are arranged on the outer part of the third panel 3, whereas the rest of this other portion 502 is arranged on the joining flange 7 adhered to the second panel 2. However, the fold line 500 could alternatively be bent inwardly, such that in the flat position, the fold line 500, one of the two portions 501 and part of the other portion 502 would be arranged between the first panel 1 and the third panel 3.

FIG. 36 shows the foldable structure halfway between the flat position and an expanded position shown in FIG. 37. As in the embodiment described above in relation to FIGS. 1 to 4, the foldable structure according to the specific embodiment shown in FIGS. 34 to 37 is configured so that, in the expanded position (FIG. 37), the first, second and third panels 1, 2, 3 form respective right trihedrons with one another. However, the values of the angles α and β here are different from one another. In any case, though it is not essential, it is advantageous for the joining flanges 7 to have a triangular shape defining an angle equivalent to angle β to facilitate the positioning of the second edge 5*b* of the link panel 5 and of the joining flange 7 with respect to the connection edge 2*a* of the second panel 2 during the assembly.

In relation to FIGS. 5 to 11, a self-expanding foldable display rack 50 incorporating a structure according to the present invention including the elements described above in relation to FIGS. 1 to 4 is described below, in which said first panel 1 is a back wall 1, said second panels 2 are side walls 2 and said third panel 3 is a shelf 3 of said display rack 50, and wherein the mentioned shelf 3 is connected at its ends to said side walls 2 by corresponding link panels 5. The mentioned back wall 1 and said side walls 2 are formed from a first sheet piece 51 (shown separately in FIG. 5) of a relatively rigid material. In this first sheet piece 51, the hinges between the back wall 1 and the side walls 2 are provided by longitudinal fold lines 21. The first sheet piece 51 furthermore comprises a pair of transverse fold lines 14 relatively close to one another and perpendicular to said longitudinal fold lines 21, and the functionality of which will be described below. Coupling configurations 23 provided for securing the ends of elastic bands 4, as will be described below, are formed in the side walls 2.

Figure 9:
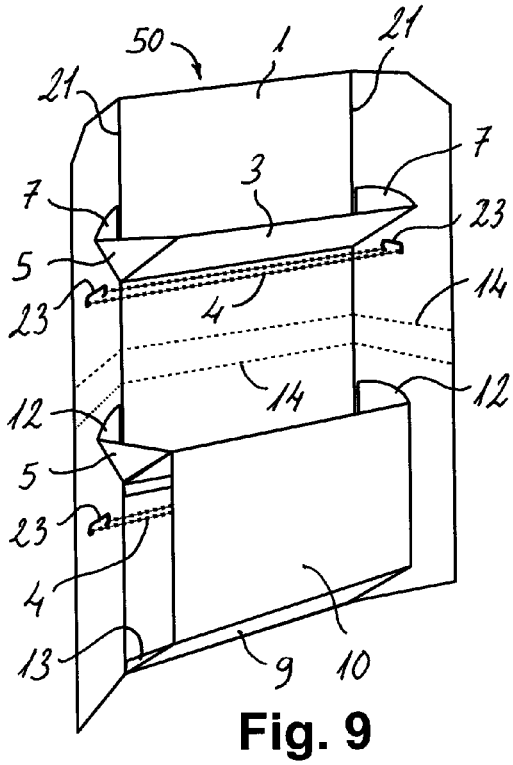
FIG. 9 is a perspective view of the display rack of FIG. 8 in a transition position between the expanded position and a flat position, or vice versa.

The shelf 3 and the link panels 5 are formed from a second sheet piece 52 of a relatively rigid material, in which the hinges between the shelf 3 and the link panels 5 are fold lines. The second sheet piece 52 furthermore includes a first joining flange 6 connected to a back edge of the shelf 3 at a fold line and second joining flanges 7 connected to the second edges 5*b* of the link panels 5 at respective fold lines. In an operative position, the mentioned first joining flange 6 is joined, for example by adhesive, to an inner face of the back wall 1, and said second joining flanges 7 are joined, for example by adhesive, to the inner faces of the corresponding side walls 2, as is shown in FIG. 9. The display rack 50 could obviously include several shelves 3, in which case each additional shelf and its corresponding link panels would be formed from an additional sheet piece that is similar or equivalent to the second sheet piece 52.

Figure 8:
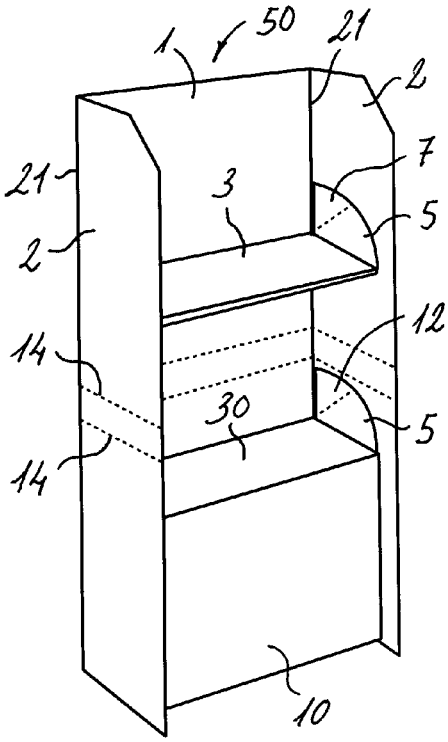
FIG. 8 is a perspective view of the display rack formed from the sheet pieces of FIGS. 5, 6 and 7 in an expanded position.

As shown in FIGS. 8 and 9, the display rack 50 furthermore comprises a pedestal formed by a lower shelf 30, a base panel 9 with a back edge hingedly joined to a lower edge of the back wall 1, and a front wall 10 with upper and lower edges hingedly joined to front edges of said lower shelf 30 and of said base panel 9, respectively. The mentioned lower shelf 30 is connected at its ends to the side walls 2 through corresponding link panels 5. The base panel 9 is parallel to the lower shelf 30 and said front panel 10 is parallel to the back wall 1 forming a hinged parallelogram facilitating the folding of said pedestal. The lower shelf 30, the link panels 5, the base panel 9 and the front panel 10 are formed from a third sheet piece 53 of a relatively rigid material, in which the hinges between the lower shelf 30 and the link panels 5 are fold lines, the hinge between the lower shelf 30 and the front panel 10 is a fold line, and the hinge between the front panel 10 and the base panel 9 is a fold line. The mentioned third sheet piece 53 furthermore comprises a first joining flange 11 connected to a back edge of the lower shelf 30 at a fold line, second joining flanges 12 connected to the second edges 5*b* of the link panels 5 at respective fold lines, and a third joining flange 13 connected to a back edge of the base panel 9 at a fold line. In the operative position, said first and third joining flanges 11 are joined, for example, by adhesive, to an inner face of the back wall 1 and said second joining flanges 12 are joined, for example, by adhesive, to the inner faces of the corresponding side walls 2, as is shown in FIG. 9.

Although it is not essential, it is preferable that the shelf 3 and the lower shelf 30 form with the back wall 1 and the side walls 2 respective rectangular trihedrons in the expanded position. In such case, the acute angle $\alpha$ between the first and second edges 5*a*, 5*b* of each link panel 5 is a 45° angle and said acute angle $\beta$ between the second edge 5*b* of each link panel 5 and the connection edge 2*a* of the corresponding second panel 2 is a 45° angle. The third sheet piece 53 optionally includes, in each side of the front panel 10, a first connection panel 54 connected to the corresponding side edge of the front panel 10 and a second connection panel 55 connected to an inclined edge of the first connection panel 54. The second connection panel 55 has an upper edge aligned with the fold line between the lower shelf 30 and the front panel 10, and a joining flange 56 extends from this upper edge to be joined, in the operative position, for example by adhesive, to a lower surface of the lower shelf 30, next to the side edge thereof. The fold line between the first and second connection panels 54, 55 forms a 45° angle with the side edge of the front panel 10. These first and second connection panels 54, 55 provide strength to the front panel 10 and collaborate in the kinematic connection between the panels of the display to facilitate the folding and unfolding operations.

A pair of elastic elements, for example in the form of elastic bands 4, are connected at the ends thereof to the mentioned coupling configurations 23 formed in the side walls 2 of the structure, such that said elastic bands 4 pull the side walls 2 towards one another to go from the flat situation, in which the back wall 1 and the side walls 2 are substantially coplanar, to an expanded position, in which the back wall 1 forms respective dihedrons with the side walls 2. The kinematic connection between the shelves 3, 30 and the side walls 2 provided by the link panels 5 causes the shelves 3, 30 to automatically adopt a position substantially coplanar with the back wall 1 and the side walls 2 in the flat position (close to the one shown in FIG. 9) and a position in which the shelves 3, 30 form trihedrons with the back wall 1 and side walls 2 in the expanded or working position (shown in FIG. 8). Furthermore, the link panels 5 act as support means to support the ends of the shelves 3, 30 in the expanded position, and the force of the elastic bands 4 keeps the side walls 2 pressed against the edges of the shelves 3, 30 in the expanded position preventing them from being able to open. The folding of the display from the expanded position to the flat position is done by manually opening the side walls 2 outwardly against the force of the elastic bands 4.

Figure 10:
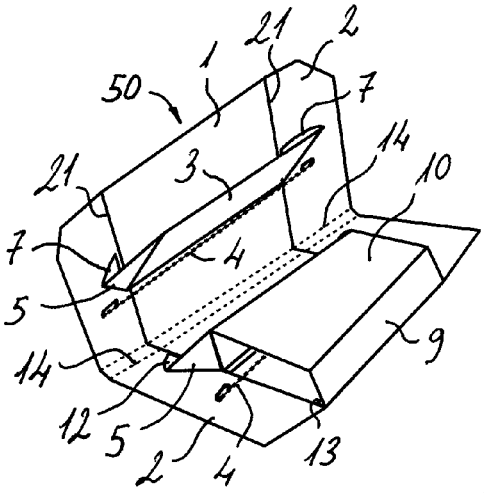
FIG. 10 is a perspective view of the display rack of FIG. 8 in a transition position between the flat position and a compact folded position, or vice versa.
Figure 11:
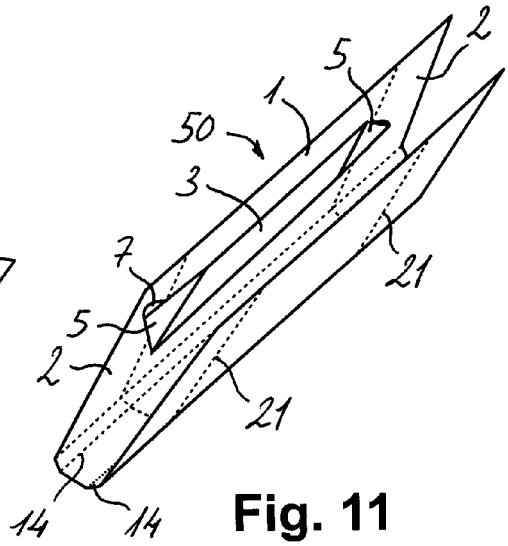
FIG. 11 is a perspective view of the display rack of FIG. 8 in the compact folded position.

From the flat position (close to the one shown in FIG. 9), the structure of the present invention can be bent along the mentioned transverse fold lines 14 of the first sheet piece 51 until superimposing an upper part of the structure on a lower part thereof in a compact folded position shown in FIG. 11. FIG. 10 shows an intermediate transition position between the flat position and the compact folded position, or vice versa. The separation distance between the transverse fold lines 14 in the first sheet piece 51 is selected to accommodate the shelf 3 and the pedestal and generally determines the thickness of the display in the compact folded position. In the compact folded position, the bending along the transverse fold lines 14 prevents the bending along the longitudinal fold lines 21 and cancels out the action of the elastic bands 4, such that the display is stably maintained in the compact folded position. When a movement for separating the two superimposed upper and lower parts of the display from the compact folded position shown in FIG. 11 is manually initiated, the force of the elastic bands makes the display unfold and stand up automatically to the expanded position shown in FIG. 8. Alternatively, the first sheet piece 51 could include additional separate groups of transverse fold lines 14, to allow zigzag folding of the display from the flat position to the compact folded position.

Figure 12:
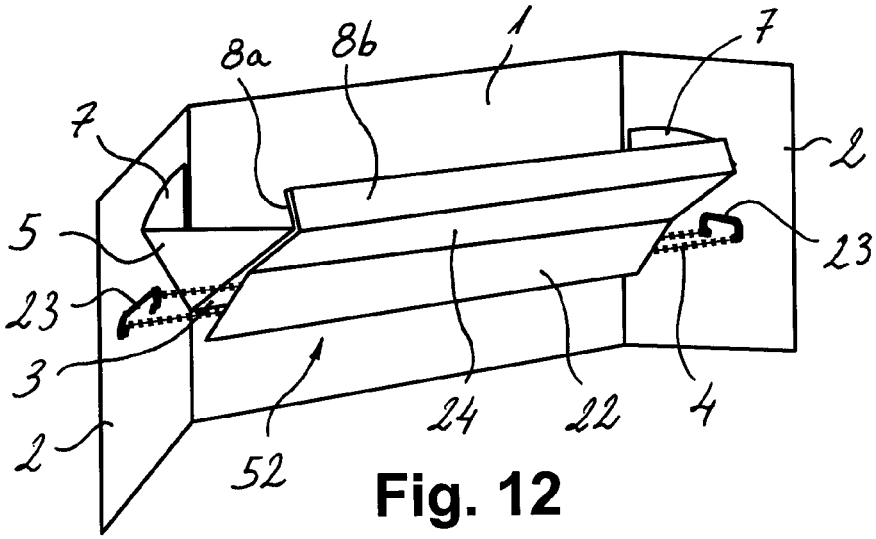
FIGS. 12, 13 and 14 are perspective views respectively showing three different embodiments for an improvement of the shelf of the display rack of FIG. 8 in a transition position between the flat position and the expanded position, or vice versa.
Figure 13:
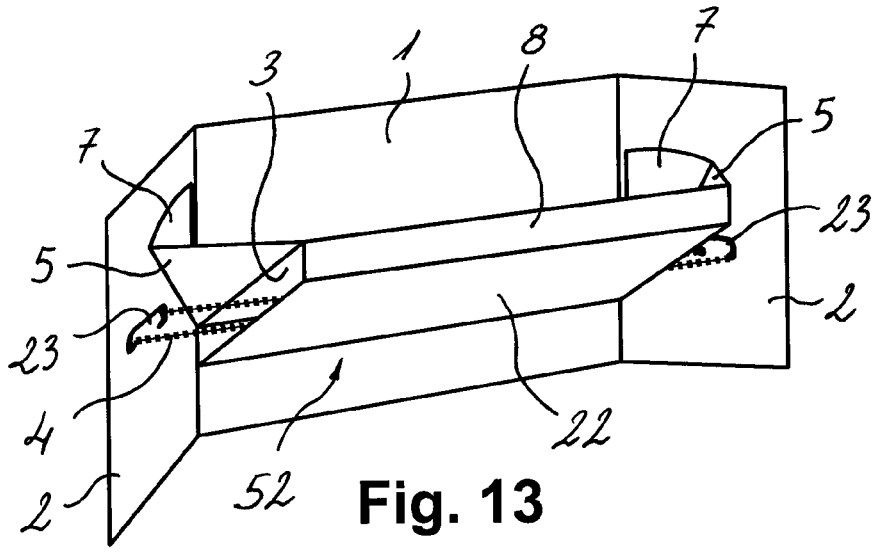
Figure 14:
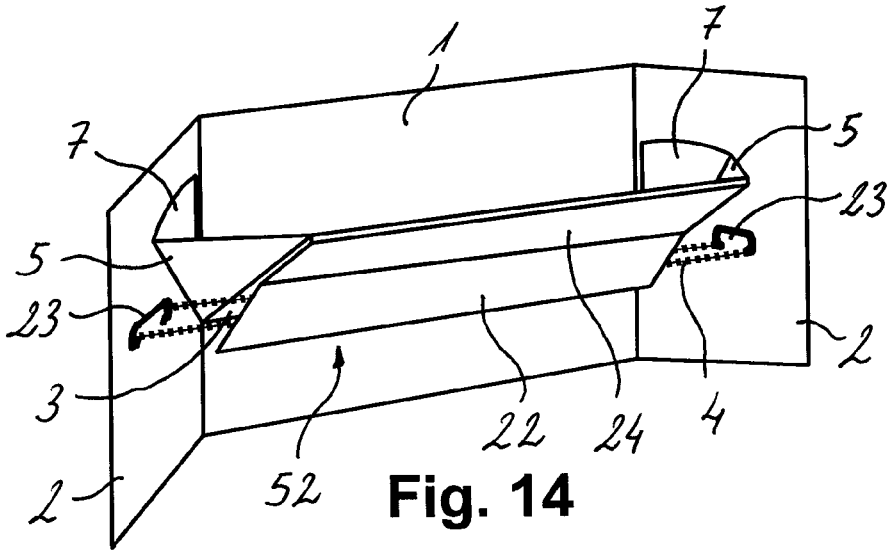

The coupling configurations 23 are arranged in the side walls 2 such that the elastic bands 4 pass immediately below the shelf 3 and the lower shelf 30, respectively. FIGS. 12, 13 and 14 show three different embodiments for an improved shelf 3 that can be applied to the display rack 50. In these embodiments, the shelf 3 and the link panels 5 are integrated in a second sheet piece 52 furthermore comprising several additional portions arranged consecutively below the shelf 3 forming a band and connected with one another at fold lines, including a lower flange or panel 22 to conceal the elastic band 4 at least in part. The display to which the different examples of improved shelf 3 are applied includes a back wall 1 and side walls 2 partially shown in a transition position between the flat position and the expanded position, or vice versa, in FIGS. 12, 13 and 14, and the improved shelf 3 is connected to the side walls 2 through link panels 5, in a manner similar to that described above.

In the embodiment shown in FIG. 12, the additional portions of the second sheet piece 52 include inner and outer reinforcement and railing panels 8*a*, 8*b* connected consecutively with one another at a fold line, with the inner reinforcement and railing panel 8*a* connected to the front edge of the shelf 3 at another fold line, a reinforcement panel 24 connected to an edge of the outer reinforcement and railing panel 8*b* at another fold line and a lower flange 22 connected to said reinforcement panel 22 at yet another fold line. In the operative position, the inner reinforcement and railing panel 8*a* is bent upwardly and the outer reinforcement and railing panel 8*b* is bent on the inner reinforcement and railing panel 8*a* and joined thereto, for example, by adhesive, the mentioned reinforcement panel 24 is bent on the lower face of the shelf 3 and joined thereto, for example, by adhesive, whereas said lower flange 22 is suspended in cantilever. The elastic band 4 is arranged between the shelf 3 and the lower panel 22 such that it is concealed thereby in the expanded position, and the inner and outer reinforcement and railing panels 8*a*, 8*b* constitute a double ply railing which permanently forms a dihedral angle with the shelf 3, for example a right dihedral angle, which prevents the articles or products arranged on the shelf from falling and at the same time reinforces the front edge of the shelf 3.

In the embodiment shown in FIG. 13, the mentioned additional portions of the second sheet piece 52 include a reinforcement panel 8 connected to a front edge of the shelf 3 at a fold line and a lower panel 22 connected to said reinforcement panel 8 at a fold line. The shelf 3 and the lower panel 22 are hingedly joined at their back edges to the back wall 1, either by means of respective joining flanges or by a joining panel connected to the shelf 3 or to the lower panel 22 at a fold line and provided with a joining flange for being joined to the other of the shelf 3 or lower panel 22. In the operative position, the reinforcement panel 8 is parallel to the back wall 1 and the lower panel 22 is parallel to the shelf 3 forming a hinged quadrilateral which facilitates the folding. The elastic band 4 is arranged between the back wall 1, the shelf 3, the reinforcement panel 8 and the lower panel 22 such that it is concealed thereby in the expanded position. Furthermore, the reinforcement panel 8 and the shelf 3 form a dihedral angle, optionally a right dihedral angle, in the expanded position, which reinforces the front edge of the shelf 3.

In the embodiment shown in FIG. 14, the additional portions of the second sheet piece 52 include a reinforcement panel 24 connected to a front edge of the shelf 3 at a fold line and a lower flange 22 connected to said reinforcement panel 22 at a fold line. In the operative position, the mentioned reinforcement panel 24 is bent on the lower face of the shelf 3 and joined thereto, for example, by adhesive, whereas said lower flange 22 is suspended in cantilever. The elastic band 4 is arranged between the shelf 3 and the lower panel 22 such that it is concealed thereby in the expanded position, and the reinforcement panel 8 reinforces the front edge of the shelf 3.

Figure 5:
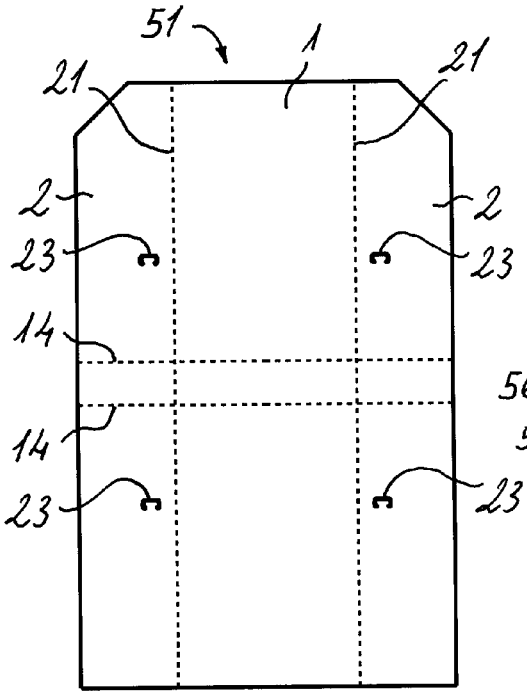
FIGS. 5, 6 and 7 are plan views of first, second and third sheet pieces forming part of a self-expanding foldable structure for a display rack according to an embodiment of the present invention.
Figure 6:
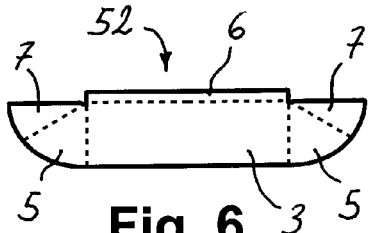
Figure 7:
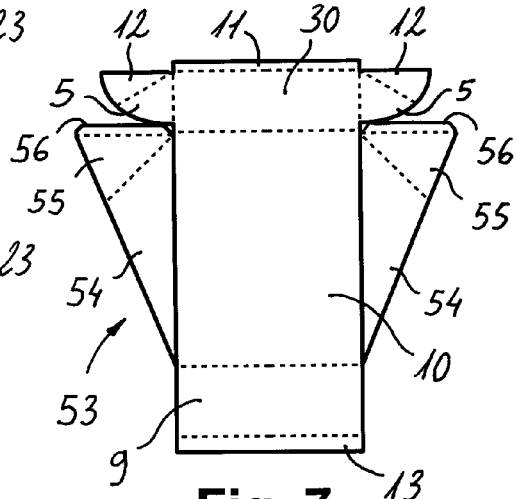

The first, second and third sheet pieces 51, 52, 53 shown in FIGS. 5, 6 and 7, respectively, are preferably made of corrugated cardboard, although they could also be made of other types of cardboard, plastic, corrugated plastic, or foam board, among other materials. The relatively rigid sheet material of which the first sheet piece 51 is made has an inner structure suitable for withstanding stresses in one or more directions parallel to the plane of the outer faces thereof. In the case of the foam board, the inner structure does not have a predominant strength direction. In the case of corrugated cardboard or plastic, the inner structure is formed by one or more corrugated sheets forming flutes providing a predominant strength in a direction parallel to such flutes. The longitudinal fold lines 21 can be classic scored lines involving a crushing or thinning of the inner structure of the relatively rigid sheet material, optionally including two parallel scored lines, considerably close to one another, separated by a distance related to the thickness of the relatively rigid sheet material. The mentioned scored lines can be applied to the longitudinal fold lines 21 given that they have little effect on the strength of the frame in the vertical direction. In contrast, if the scored lines are used for the transverse fold lines 14, the crushing of the inner structure of the relatively rigid sheet material would interrupt the continuity of such inner structure along a horizontal waist and would weaken the capacity of the structure of the display rack in the vertical direction to withstand the weight of the articles or products supported on the shelves 3, 30. Furthermore, when the relatively rigid sheet material is bent around transverse fold lines formed by scored lines to go from the flat position to the compact folded position, or vice versa, the strength of the relatively rigid sheet material in the vertical direction would be further reduced, which is a serious drawback taking into account that most of the weight of the articles or products arranged on the shelf 3 is transmitted to the side walls 2 through the link panels 5.

Figure 15:
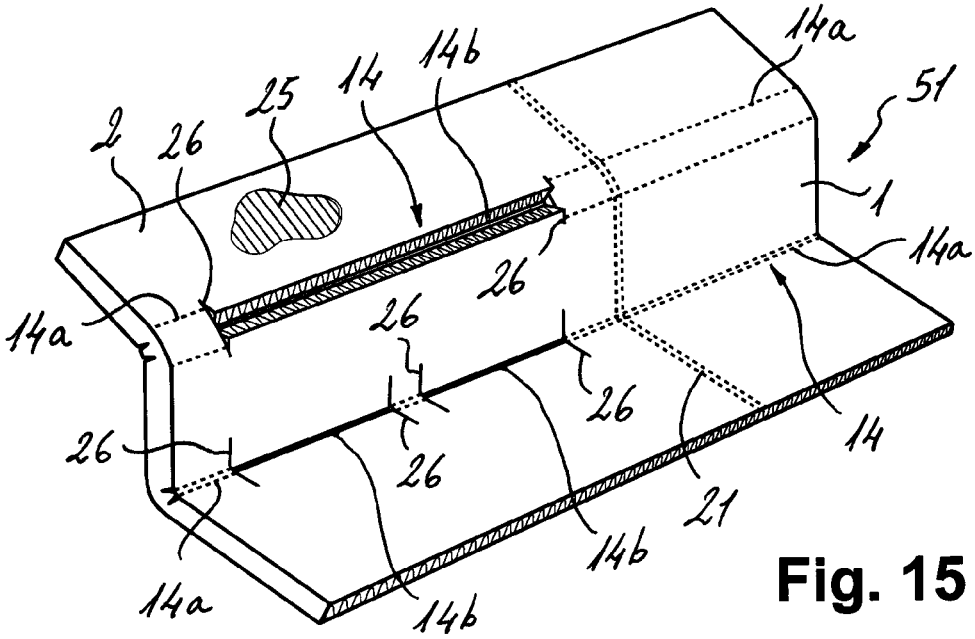
FIG. 15 is a partial perspective view showing a constructive detail of the self-expanding foldable structure of the display rack shown in FIG. 8 in a transition position between the flat position and a compact folded position, or vice versa.
Figure 16:
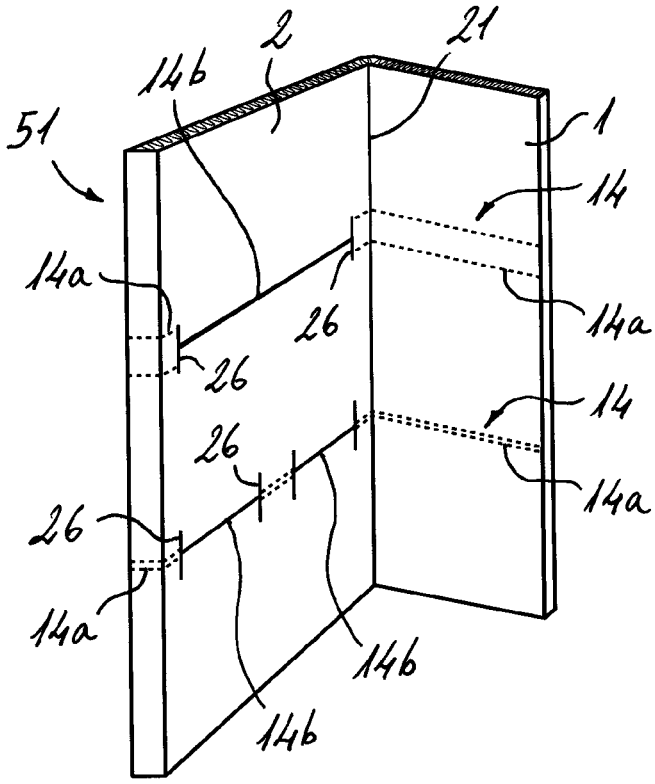
FIG. 16 is a partial perspective view showing the constructive detail of FIG. 15 in an expanded position.

As is shown in FIGS. 15 and 16, in order to contribute to solving the problem described above, according to the present invention each transverse fold line 14 includes, along the width of the two side walls 2, one or more scored sections 14*a*, in which the inner structure of the relatively rigid sheet material is crushed, in combination with one or more cut sections 14*b* in which the inner structure of the relatively rigid sheet material is cut but not crushed, and has flat edges (FIG. 15) that can mutually face and support one another when the display is in the expanded position (FIG. 16). The upper part of FIG. 15 shows the outer side of a transverse fold line 14 and the lower part of FIG. 15 shows the inner side of a transverse fold line 14. Preferably, each of the cut sections 14*b* comprises a cut in a direction substantially perpendicular to the outer faces of the relatively rigid sheet material which penetrates at least a substantial part of the thickness of the relatively rigid sheet material from the outer face thereof located in the outer side with respect to the folding direction. However, due to manufacturing process needs, the mentioned cut in the cut sections 14*b* can be completed when it is made from the same side of the relatively rigid sheet material which will be the inner side with respect to the folding direction.

When the relatively rigid sheet material used is corrugated plastic or corrugated cardboard, the inner flutes 25 (FIG. 15) forming the inner structure thereof are arranged substantially parallel to the vertical direction in order to better withstand the weight of the articles or products supported on the shelves 3, 30 and, accordingly, are substantially perpendicular to said scored sections 14*a* and cut sections 14*b* of the transverse fold lines 14. When the display is placed in its expanded position (FIG. 16), in the cut sections 14*b*, the cut edges of the flutes 25 of the upper portions of the side walls 2 are supported on the cut edges of the flutes 25 of the lower portions of the side walls 2 and the continuity of the inner structure of the relatively rigid sheet material is thereby restored. It will be understood that although the relatively rigid sheet material used does not have a predominant strength direction, as is the case of foam board, the cut sections 14*b* of the transverse fold lines 14 will provide an equivalent beneficial effect.

As shown in FIGS. 15 and 16, the scored sections 14*a* can be made up of two parallel scored lines which are mutually separated and substantially equidistant from the adjacent cut section or sections 14*b* (FIG. 15). The separation between the two mentioned scored lines will be related to the thickness of the relatively rigid sheet material. Furthermore, the first sheet piece 51 includes short limit cuts 26 which are transverse to the transverse fold line 14, in the limit between the scored sections 14*a* and the cut sections 14*b*. The mentioned limit cuts 26 prevent tears and breaks from occurring at the ends of the scored sections 14*a* in the sheets forming the outer faces of the relatively rigid sheet material. Obviously, though it is not necessary, the scored sections 14*a*, cut sections 14*b* and limit cuts 26 described above can also be incorporated along the transverse fold line 14 in the back wall 1.

Now in reference to FIGS. 17 to 20, it can optionally be suitable for the side walls 2 to be completely or partially double ply, i.e., they have a complete inner ply in which the coupling configurations 23 can be die cut (such as the side walls 2 in the first sheet piece 51 of FIG. 5), and a complete or incomplete additional ply 27 (not shown in FIG. 5) which can be in the outer part of the display for the purpose of concealing the coupling configurations 23 from being seen from the outer of the side walls 2 or in the inner part thereof. The outer ply 27 of the side walls 2 can preferably form part of the first sheet piece 51 in the form of second ply side panels 27 connected to the front edges of the side walls 2 along fold lines. In the operative position these second ply side panels 27 can be bent on the corresponding outer or inner faces of the side walls 2 and joined thereto, for example by adhesive. The fact that the side walls 2 are two-faced side walls is beneficial, on one hand, for increasing the strength thereof, and on the other hand they make the side walls 2 have smooth front edges 28 in which, if said bent second ply side panels 27 did not exist, unappealing cut edges would be seen, exposing the inner structure of the rigid sheet material. For the sake of clarity in the drawing, FIGS. 17 to 20 only show a portion of a side wall 2 and a bent portion of the corresponding second ply panel 27 including part of a transverse fold line 14.

Figure 17:
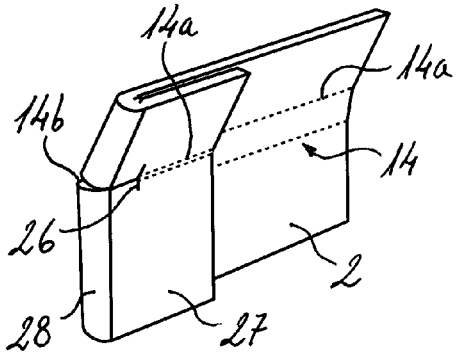
FIGS. 17 and 18 are partial perspective views showing another constructive detail of a display rack of the type shown in FIG. 8 in a transition position between the flat position and a compact folded position, or vice versa, from a rear and front point of view, respectively.
Figure 18:
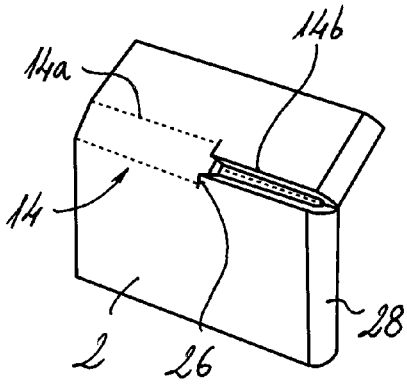

When the portion bent of the second ply panel 27 is in the inner side of the side wall 2 with respect to the folding direction around the transverse fold line 14, as is shown in FIGS. 17 and 18, this transverse fold line 14 includes, in the side wall 2, one of said cut sections 14*b* formed in the side wall 2 covering the entire horizontal extension of the second ply panel 27. In the horizontal extension limit of the second ply panel 27 there will be a corresponding cut limit 26 from which a scored section 14*a* will continue. Preferably, as is shown in FIG. 17, the cut section 14*b* which is made in the entire horizontal extension of the second ply panel 27 furthermore covers the corresponding smooth front edge 28 and extends along a small part of the horizontal extension of the second ply panel 27, which is in the inner side with respect to the folding direction. In the rest of the horizontal extension of the second ply panel 27, the transverse fold line 14 is completed with a scored section 14*a* and a cut limit 26 separates it from the cut section 14*b*, as is shown in FIG. 18.

Figure 19:
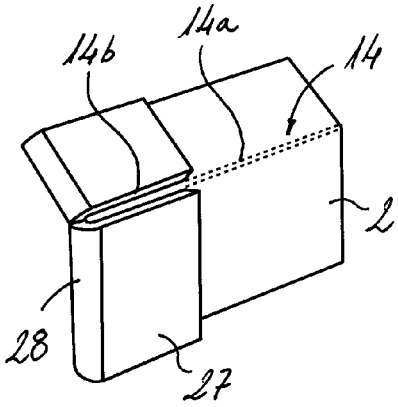
FIGS. 19 and 20 are partial perspective views showing yet another constructive detail of a display rack of the type shown in FIG. 8 in a transition position between the flat position and a compact folded position, or vice versa, from a rear and front point of view, respectively.
Figure 20:
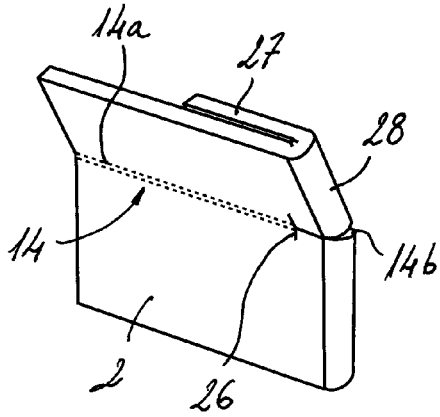

In contrast, when the second ply panel 27 is in the outer side with respect to the folding direction around the transverse fold line 14, as is shown in FIGS. 19 and 20, this transverse fold line 14 includes, in the side wall 2, one of said cut sections 14*b* formed in the second ply panel 27 along the entire horizontal extension thereof (FIG. 19). As is shown in FIG. 20, the cut section 14*b* which is made in the entire second ply panel 27 preferably covers the corresponding smooth front edge 28 and furthermore extends along the side wall 2, which is in the inner side with respect to the folding direction, along a part of the horizontal extension of the second ply panel 27. In the limit of the cut section 14*b* there is a corresponding cut limit 26 from which a scored section 14*a* continues. In summary, the transverse fold line 14 will include a cut section 14*b* covering the entire horizontal extension of the second ply panel 27 either in the side wall 2 or in the second ply panel 27, in the one of the two located on the outer side with respect to the folding direction.

Figure 21:
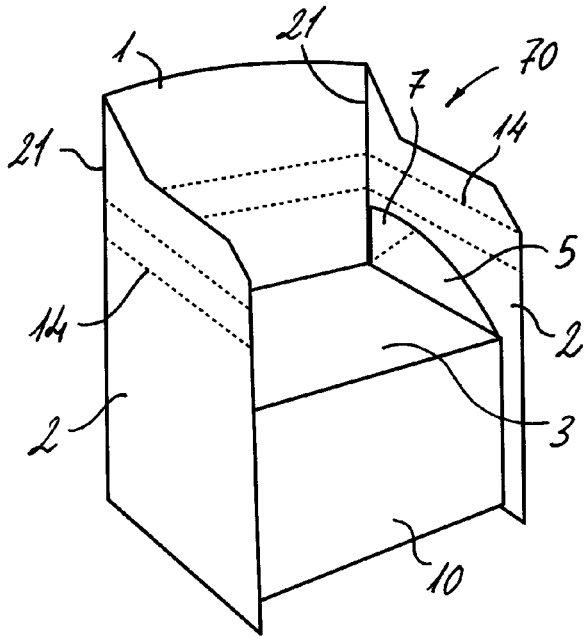
FIG. 21 is a perspective view of a self-expanding foldable display seat according to another embodiment in an expanded position.
Figure 22:
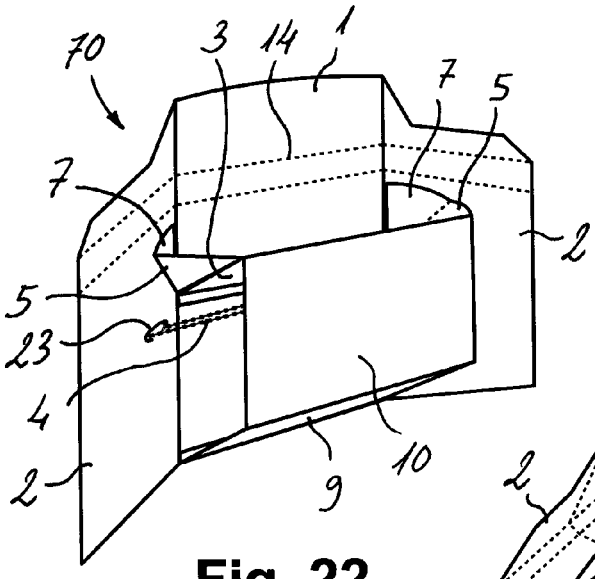
FIG. 22 is a perspective view of the display seat of FIG. 21 in a transition position between the expanded position and a flat position, or vice versa.
Figure 23:
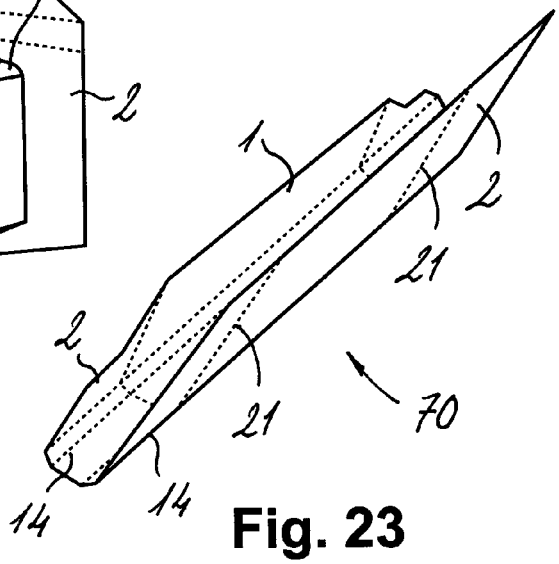
FIG. 23 is a perspective view of the display seat of FIG. 21 in a compact folded position.

FIGS. 21, 22 and 23 show another example of application of the self-expanding foldable structure, wherein the mentioned first panel 1 of the structure is a support and backing member 1, the second panels 2 are support and armrest members 2 and the third panel is a seat 3 of a self-expanding foldable display seat 70 useful for supporting graphic or printed information and as a seat. The construction of the part of the seat of this display seat 70 is similar to the part of the pedestal of the display rack 50 described above. The part of the seat is formed by the seat 3, a base panel 9 with a back edge hingedly joined to a lower edge of the support and backing member 1, and a front support member 10 with upper and lower edges hingedly joined to front edges of the seat 3 and of said base panel 9, respectively. The seat 3 is connected at its side ends to the support and armrest members 2 through corresponding link panels 5. The base panel 9 is parallel to the seat 3 and said front support member 10 is parallel to the support and backing member 1 forming a hinged parallelogram which facilitates the folding of said pedestal. The support and backing member 1 and the support and armrest members 2 can be formed from a first sheet piece of a relatively rigid material and the seat 3, the link panels 5, the base panel 9 and the front support member 10 can be formed from a second sheet piece of a relatively rigid material. The mentioned relatively rigid sheet material of the first and second pieces can preferably be corrugated cardboard, although it could also be cardboard, plastic, corrugated plastic, or foam board, among other materials.

An elastic element, such as an elastic band 4, is connected at its ends to the support and armrest members 2 to push the display seat 70 towards the expanded position shown in FIG. 21. By manually separating the support and armrest members 2 against the force of the elastic band 4, the display seat can adopt a flat position close to the one shown in FIG. 22. The support and backing member 1 and the support and armrest members 2 include transverse fold lines 14 along which the display seat 70 can be folded from the flat position to a compact folded position shown in FIG. 23. The force of the elastic band can make the display seat 70 unfold and stand up automatically from the compact folded position to the expanded position from a simple initial manual movement. First and second connection panels similar to the first and second connection panels 54, 55 described above in relation to the third sheet piece 53 of the display rack 50, shown in FIG. 7, or other folding reinforcement panels to reinforce the support of the seat can optionally be arranged on each side of the front support member 10.

Now in relation to FIGS. 24 to 31, another example of application of the expanding foldable structure in which said first panel 1 is a first quadrilateral side wall 1, said second panels 2 are first and second polygonal base walls 2, and said third panel 3 is a second quadrilateral side wall 3 of a self-expanding foldable prismatic display 60, which furthermore comprises a number of additional quadrilateral side walls 62, 63, is described below. The first and second polygonal base walls 2 are equal and have the shapes of a preferably regular polygon, although it is not essential, and the total number of first, second and additional quadrilateral side walls 1, 3, 62, 63 is equal to the number of sides of said first and second polygonal base walls 2. The first quadrilateral side wall 1 is hingedly joined to the first and second polygonal base walls 2 and the second quadrilateral wall 3 is linked to the first and second polygonal base walls 2 by respective link panels 5. The first, second and additional quadrilateral side walls 1, 3, 62, 63 are hingedly joined together at their respective opposing side edges. An elastic element, such as an elastic band 4, is connected at its ends to both of the first and second polygonal base walls 2.

Of course in the prismatic display 60, each of the link panels 5 has first and second edges 5*a*, 5*b* forming an acute angle $\alpha$ with one another, and the second edge 5*b* of each link panel 5 is joined to the corresponding first or second polygonal base wall 2 in an inclined position forming an acute angle $\beta$ with the connection edge 2*a* of the corresponding first or second polygonal base wall 2 with the first quadrilateral wall 1.

FIGS. 24 to 28 show a first embodiment of the prismatic display 60 in which the first and second polygonal base walls 2 are square, and accordingly there are four first, second and additional quadrilateral side walls 1, 3, 62, 63, which are also square. The first and second polygonal base walls 2 and the first, second and additional quadrilateral side walls 1, 3, 62, 63 are formed from a single sheet piece 61 (shown in FIG. 24) of a relatively rigid material, such as cardboard, corrugated cardboard, plastic, corrugated plastic and foam board, among others. In this single sheet piece 61, the first, second and additional quadrilateral side walls 1, 3, 62, 63 are arranged consecutively adjacent forming a band and are connected to one another along fold lines. The hinges between the first quadrilateral side wall 1 and the first and second polygonal base walls 2 are likewise fold lines, and the hinges between the second quadrilateral side wall 3 and the link panels 5 are also fold lines. The first and second quadrilateral side walls 1, 3 are arranged at the ends of the mentioned band, and the single sheet piece 61 comprises a first joining flange 15 connected to an edge of the first quadrilateral wall 1 at a fold line, which joining flange 15 in the operative position is adhered to an edge of the second quadrilateral side wall 3, or vice versa. Likewise, the single sheet piece 61 comprises second joining flanges 16 connected to the second edges 5*b* of the link panels 5 at respective fold lines, which in the operative position are adhered to inner faces of the corresponding first and second polygonal base walls 2. Additionally, the single sheet piece 61 comprises first connection panels 17 connected to end edges of one of the additional side walls 62 at respective fold lines and second connection panels 18 connected to end edges of another one of the additional adjacent side walls 63 at respective fold lines. These first and second connection panels 17, 18 have contiguous 45° beveled edges, hingedly joined together by joining flanges 65 in the operative position.

Figure 26:
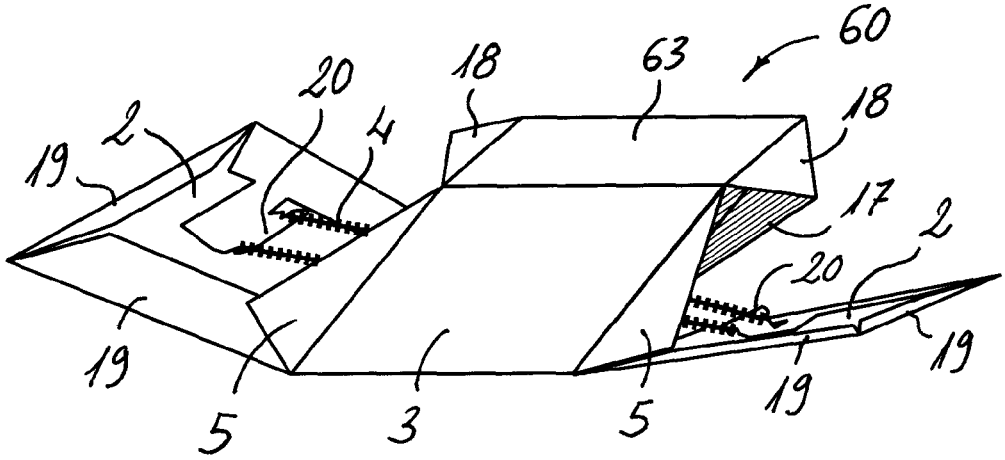
FIG. 26 is a perspective view of the self-expanding foldable prismatic display made from the sheet piece of FIG. 24 in a transition position between a flat position and an expanded position, or vice versa.
Figure 27:
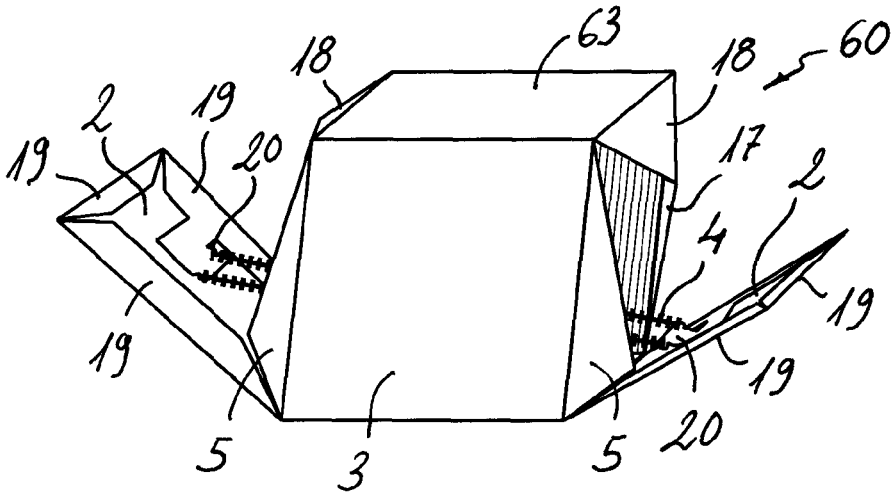
FIG. 27 is a perspective view of the prismatic display made from the sheet piece of FIG. 24 in another transition position between the flat position and the expanded position, or vice versa.
Figure 28:
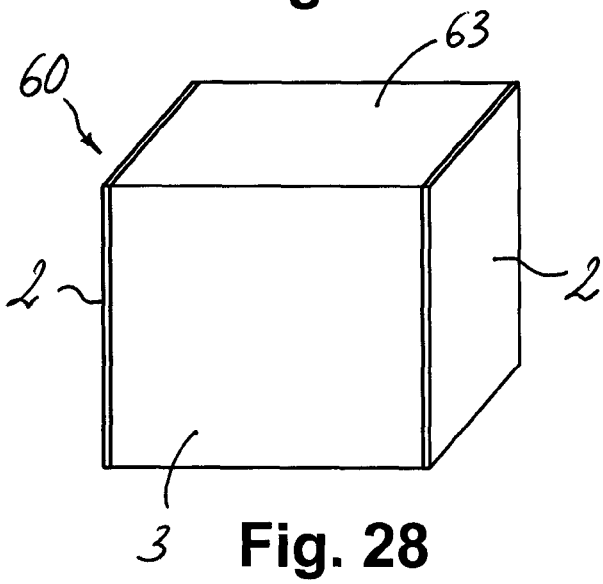
FIG. 28 is a perspective view of the prismatic display made from the sheet piece of FIG. 24 in the expanded position.

The single sheet piece 61 furthermore comprises several beveled flaps 19 connected to free edges of the first and second polygonal base walls 2 along fold lines. In the operative position, these beveled flaps 19 are adhered to inner faces of the first and second polygonal base walls 2 for the purpose of reinforcing their edges and so that the first and second polygonal base walls 2 have smooth free edges. In each of the first and second polygonal base walls 2, a coupling configuration 20 connected to the corresponding beveled flap 19 at a fold line extends from one of said beveled flaps 19. As previously mentioned, the elastic element is an elastic band 4 which is connected at its ends to both of said coupling configurations 20 in the first and second polygonal base walls 2 (FIGS. 26 and 27).

Figure 24:
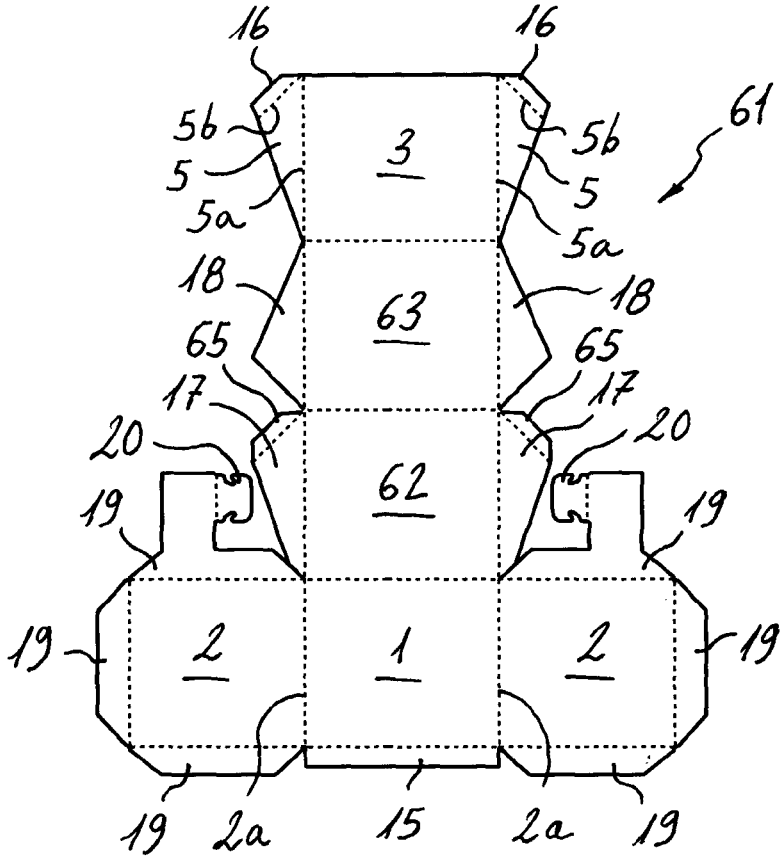
FIG. 24 is a plan view of a sheet piece forming part of a self-expanding foldable prismatic display according to another embodiment which does not make part of the present invention.
Figure 25:
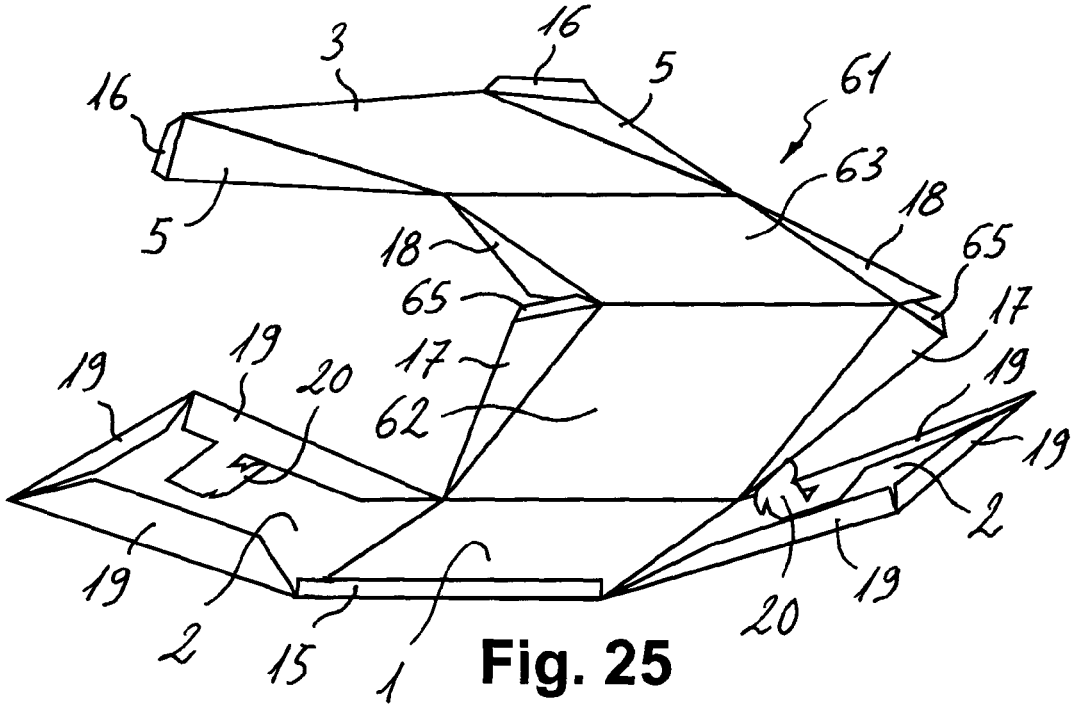
FIG. 25 is a perspective view of the sheet piece of FIG. 24 partially mounted.

FIG. 25 shows the single sheet piece 61 of FIG. 24 in a position prior to joining the joining flanges 16 and 17, for example by adhesive, to form the self-expanding foldable prismatic display 60. When the prismatic display 60 is formed, the force of the elastic band 4 pushes the first and second polygonal base walls 2 towards one another, and the link panels 5 and first and second connection panels 17, 18 establish a kinematic chain which simultaneously causes the first, second and additional quadrilateral side walls 1, 3, 62, 63 to stand up until the prismatic display 60 is in an expanded position, shown in FIG. 28, in which the first, second and additional quadrilateral side walls 1, 3, 62, 63 and the first and second polygonal base walls 2 form respective rectangular trihedrons with one another. Given that the first, second and additional quadrilateral side walls 1, 3, 62, 63 and the first and second polygonal base walls 2 are square, the prism formed by the prismatic display 60 in the expanded position is a cube, which can bear graphic or printed information on any of its six faces, and it is furthermore strong enough to serve as a pedestal for an article or product. FIG. 26 shows the prismatic display 60 in a transition position between the flat position and the expanded position, or vice versa, although it is closer to the flat position, whereas FIG. 27 shows the prismatic display 60 in another transition position between the flat position and the expanded position, or vice versa, although it is closer to the expanded position.

Figure 38:
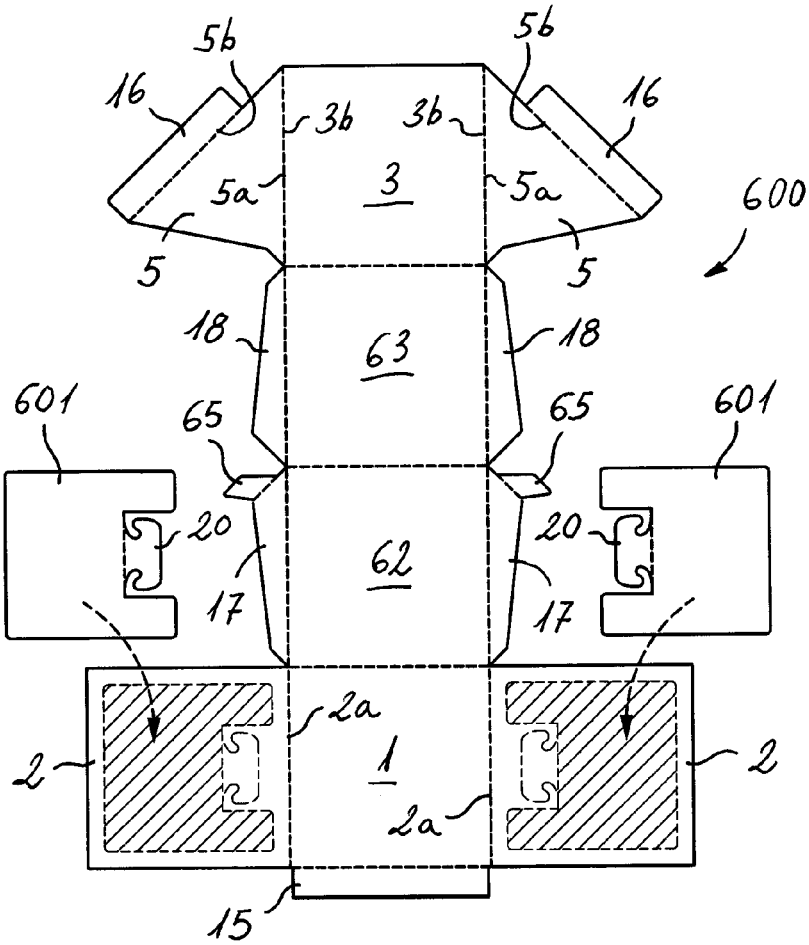
FIG. 38 is a plan view of FIG. 37.

FIG. 38 shows an embodiment variant for a prismatic display that is very similar to the one described above in relation to FIGS. 24 to 28, essentially differing from it in that it is formed from three pieces, namely, a main sheet piece 600 and two secondary sheet pieces 601, rather than a single sheet piece. The mentioned main sheet piece 600 defines a first square side wall 1 joined to opposing sides to first and second polygonal base walls 2 at fold lines 2*a*. The first quadrilateral side wall 1 and second and additional quadrilateral side walls 3, 62, 63 are joined along fold lines parallel forming a strip, and the first quadrilateral side wall 1 has on its free side a joining flange 17 for being joined to a free edge of the second quadrilateral side wall 3. The second quadrilateral side wall 3 has opposing side edges 3*b* to which first edges 5*a* of link panels 5 are joined, which have respective second edges 5*b* joined to joining flanges 16. The additional quadrilateral side walls 62 and 63 are laterally connected at respective fold lines to respective first and second connection panels 17, 18 provided with contiguous 45° beveled edges, which in the operative position are hingedly joined together by joining flanges 65. The first and second polygonal base walls 2 and the first, second and additional quadrilateral side walls 1, 3, 62, 63 are square to form a cube, although they could be rectangular to form a rectangular prism.

The main sheet piece 600 of FIG. 38 does not have the beveled flaps arranged around the first and second polygonal base walls 2 or the coupling configurations 20 for the elastic element. Instead, the coupling configurations 20 are formed in the two secondary sheet pieces 601, and they are configured to be adhered to inner faces of the first and second polygonal base walls 2. In FIG. 38, the positions which the two secondary sheet pieces 601 will adopt on the first and second polygonal base walls 2 have been indicated by means of discontinuous lines and areas in which adhesive will be applied have been indicated by means of shading. It will be observed that the two secondary sheet pieces 601 will form a considerable reinforcement for the first and second polygonal base walls 2 and that the coupling configurations 20 are free of adhesive and can be bent at respective fold lines.

Figure 29:
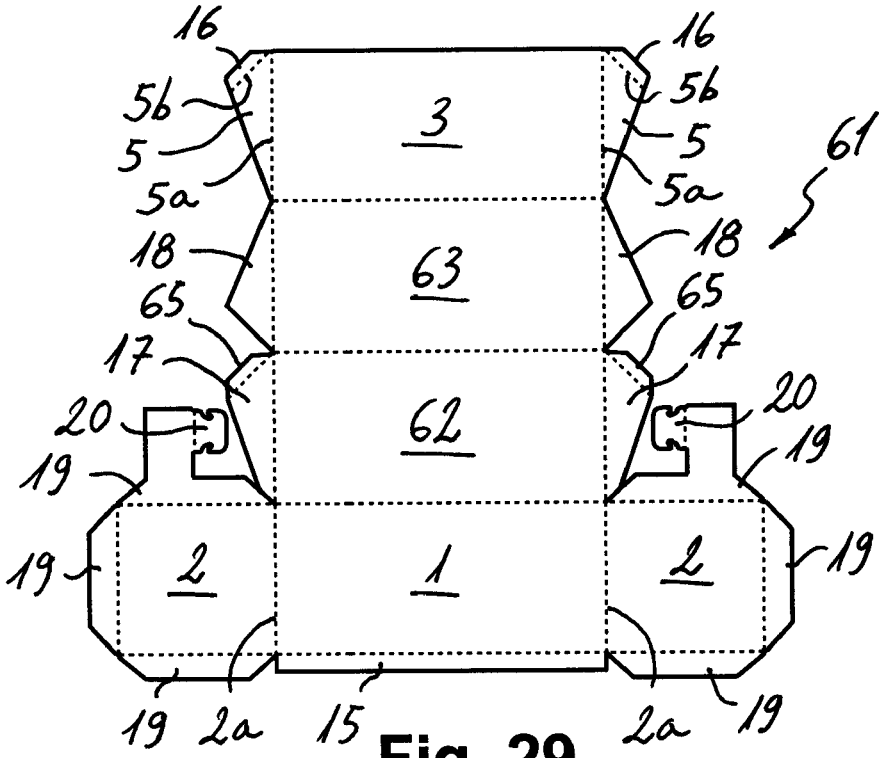
FIG. 29 is a plan view of a sheet piece forming part of a self-expanding foldable prismatic display according to yet another embodiment which does not make part of the present invention.
Figure 30:
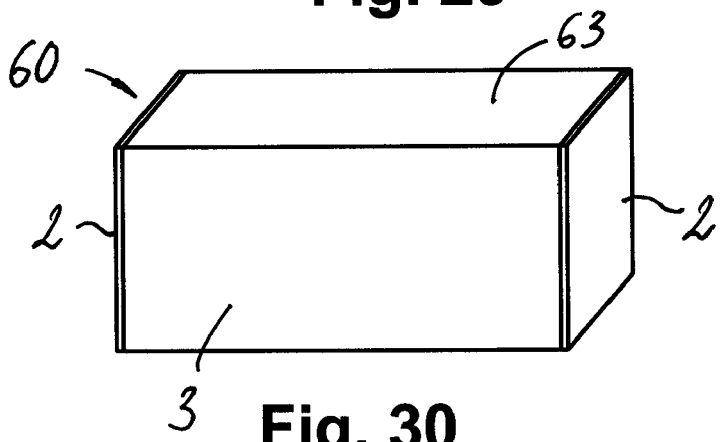
FIG. 30 is a perspective view of the prismatic display made from the sheet piece of FIG. 29 in the expanded position.

FIGS. 29 and 30 show another embodiment of the prismatic display 60, which is made from a single sheet piece 61

(shown in FIG. 29) which has features identical to the single sheet piece 61 described above in relation to FIG. 24, so the detailed description thereof will be omitted with the exception that the four first, second and additional quadrilateral side walls 1, 3, 62, 63 are rectangular instead of square, and they are also accommodated to the square shape of the first and second polygonal base walls 2. The result is a prismatic display 60 which in the expanded position has the shape of a rectangular prism, as is shown in FIG. 30.

In the prismatic display 60 forming a cubic prism described in relation to FIGS. 24 to 28, and in the cubic display formed by the sheet pieces 600 and 601 shown in FIG. 38, and in the prismatic display 60 forming a rectangular prism described in relation to FIGS. 29 and 30, the first, second and additional quadrilateral side walls 1, 3, 62, 63 and the first and second polygonal base walls 2 form respective rectangular trihedrons with one another in the expanded position, and for this reason the acute angle $\alpha$ between the first and second edges 5*a*, 5*b* of each link panel 5 is a 45° angle and the acute angle $\beta$ between the second edge 5*b* of each link panel 5 and the connection edge 2*a* of the corresponding polygonal base wall 2 is a 45° angle. However, it will be understood that each of the link panels 5 could be divided into two portions 501, 502 at a fold line 500 as in the embodiment described in relation to FIGS. 34 to 37.

Figure 31:
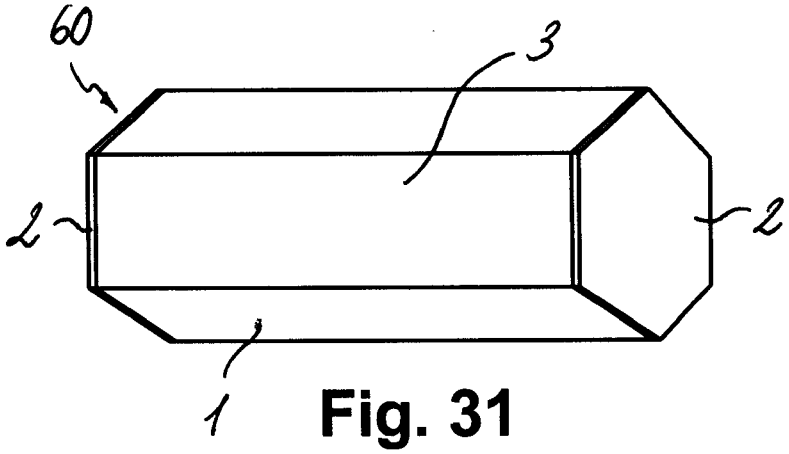
FIG. 31 is a perspective view of a self-expanding foldable prismatic display according to yet another embodiment which does not make part of the present invention.

FIG. 31 shows another embodiment of the prismatic display 60, which forms a hexagonal prism in the expanded position. This hexagonal prismatic display can be made from a single sheet piece (not shown) similar to the single sheet piece 61 shown in FIG. 29, but in which the first and second polygonal base walls 2 have a hexagonal shape and the first, second and additional quadrilateral side walls 1, 3 are six in number and rectangular-shaped, although they could also be square. Each of the first, second and additional quadrilateral side walls 1, 3 forms with said first and second polygonal base walls 2 respective right dihedral angles, but they form 120° dihedral angles with one another. In this case, the acute angle $\alpha$ between the first and second edges 5*a*, 5*b* of each link panel 5 is a 60° angle and the acute angle $\beta$ between the second edge 5*b* of each link panel 5 and the connection edge 2*a* of the corresponding polygonal base wall 2 is a 60° angle. Modifications necessary for obtaining prismatic displays that can form other regular or irregular prisms will readily occur to a person skilled in the art starting from the basic principles described above.

Figure 32:
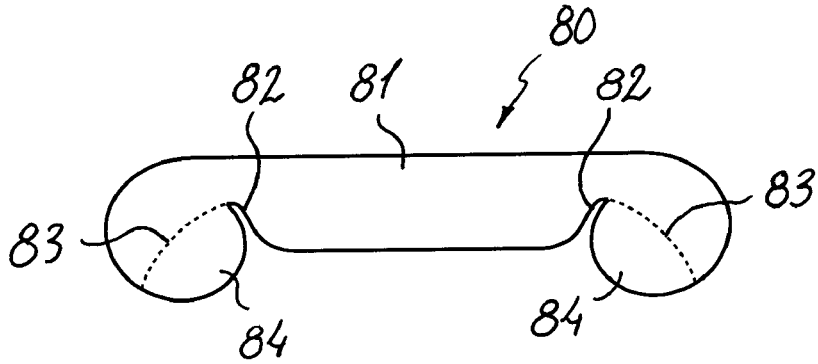
FIG. 32 is a plan view of an auxiliary retaining member configured to cooperate with one of the prismatic displays of FIGS. 24 to 31 to maintain its structure in the flat position.

FIG. 32 shows an auxiliary retaining member 80. The prismatic displays obtained from the self-expanding foldable structure are not naturally maintained in a stable flat position due to the permanent force of the elastic band 4. The mentioned auxiliary retaining member 80 is configured to engage with the panels of the structure of the prismatic display 60 for the purpose of maintaining the structure in the flat position against the force of the elastic band. To that end, the auxiliary retaining member 80 of the embodiment shown in FIG. 32 is obtained from a sheet piece of a relatively rigid material, such as cardboard, corrugated cardboard, plastic, corrugated plastic and foam board, among others, and comprises a central portion 81 between a pair of notches 82 spaced out according to the length of the quadrilateral side walls 1, 3 of the prismatic display 60, and fold lines 83 at end portions determining securing flanges 84.

Figure 33:
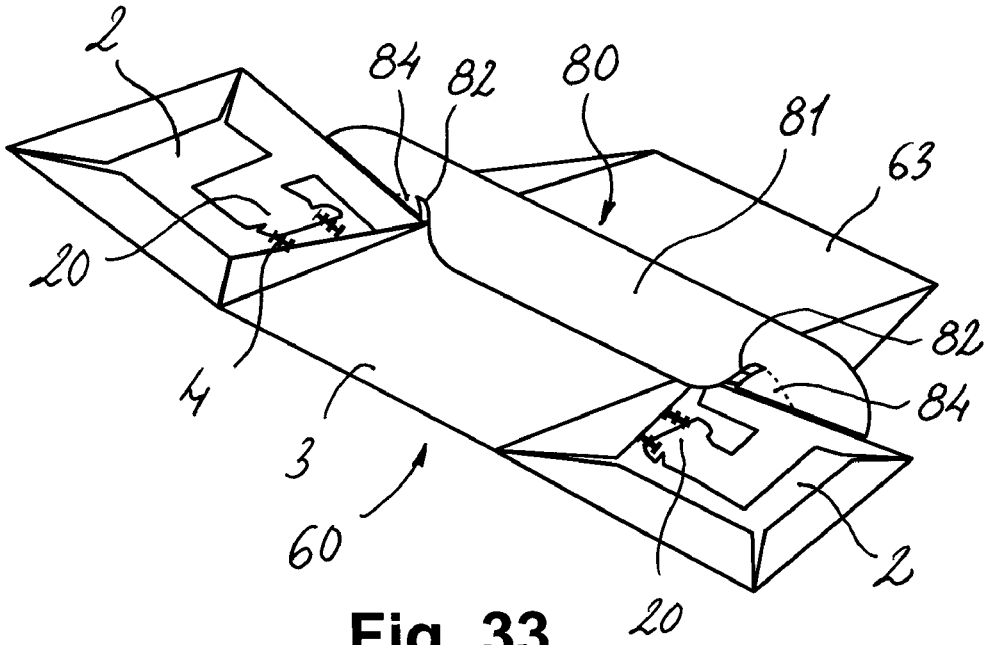
FIG. 33 is a perspective view of the auxiliary retaining member of FIG. 32 engaged with a prismatic display in the flat position.
Figure 34:
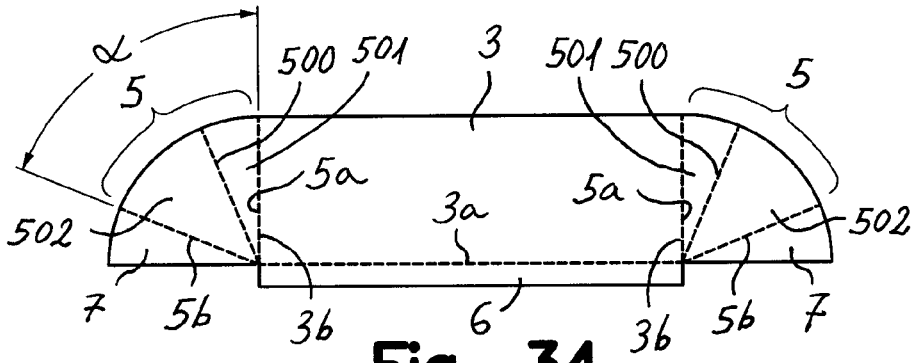
FIG. 34 is a schematic plan view of a piece of sheet material similar to that of FIG. 1, which integrates some of the elements that can form part of a self-expanding foldable structure for a display according to another embodiment of the present invention.

As is shown in FIG. 33, when the prismatic display 60 is in the flat position, the central portion 81 of the auxiliary retaining member 80 can be arranged on the quadrilateral side walls 1, 3 of the prismatic display 60 with the securing flanges 84 arranged below the first and second polygonal base walls 2 of the prismatic display 60. Thus, the auxiliary retaining member 80 maintains the prismatic display 60 in the flat position, for example, during the storage and transport thereof.

A person skilled in the art will be able to make modifications and variations from the embodiment shown and described without departing from the scope of the present invention as it is defined in the attached claims.

What is claimed is:

1. A self-expanding foldable structure for a display, comprising a back wall;

a pair of side walls having connection edges hingedly joined to opposite edges of said back wall, said side walls being pivotable about said connection edges between a flat position, in which the back and side walls are substantially coplanar, and an expanded position, in which the back and side walls form respective dihedrons with one another configuring a display rack;

at least one transverse fold line provided in said back and side walls perpendicular to said connection edges, the back and side walls being foldable about said transverse fold line from said flat position to a compact folded position;

a shelf linked to at least one of the back and side walls and configured to be arranged substantially coplanar with the back and side walls in the flat position and between the side walls forming respective dihedrons therewith in the expanded position, said shelf being supported with respect to the back and side walls in the expanded position by support means; and at least one elastic element connected to the side walls and arranged to push the structure towards the expanded position;

wherein the back wall and the side walls are made of a relatively rigid material selected from a group comprising cardboard, corrugated cardboard, plastic, corrugated plastic and foam board, said relatively rigid material having opposite planar outer faces and an inner structure suitable for withstanding stresses in one or more directions parallel to said planar outer faces; and wherein said at least one transverse fold line comprises, at least in said two side walls, one or more scored sections, in which said inner structure of said relatively rigid material is crushed along the transverse fold line, in combination with one or more cut sections, in which the inner structure of the relatively rigid material is cut but not crushed along the transverse fold line and has flat edges that mutually face and support one another when the display is in the expanded position.

2. The self-expanding foldable structure according to claim 1, characterized in that said relatively rigid material of the back and side walls is corrugated cardboard or corrugated plastic in which said inner structure comprises inner flutes arranged substantially perpendicular to said scored sections and cut sections of the transverse fold line.

3. The self-expanding foldable structure according to claim 1, characterized in that the scored sections are comprised of two parallel scored lines which are mutually separated and substantially equidistant from the adjacent cut section or sections, the separation between said two scored lines being selected according to the thickness of the relatively rigid sheet material between said outer faces.

4. The self-expanding foldable structure according to claim 1, characterized in that the transverse fold line includes limit cuts transverse thereto located at limits between the scored sections and the cut sections.

5. The self-expanding foldable structure according to claim 1, characterized in that said back wall and said side walls are formed from a first sheet piece in which the hinged joints between the back wall and the side walls are fold lines, and which includes at least one of said transverse fold lines perpendicular to said fold lines.

6. The self-expanding foldable structure according to claim 1, characterized in that said support means comprise, for each end of the shelf adjacent to one of the side walls, a link panel having first and second edges forming a first acute angle with one another, said first edge of the link panel being hingedly joined to a corresponding end edge of the shelf and said second edge hingedly joined to an inner face of the corresponding side wall in an inclined position forming a second acute angle with the connection edge of the corresponding side wall.

7. The self-expanding foldable structure according to claim 6, characterized in that the first and second edges of the link panel are oriented so that they or imaginary prolongations thereof converge in a vertex located in the connection edge of the corresponding side wall.

8. The self-expanding foldable structure according to claim 6, characterized in that said back wall, said side walls and said shelf form respective rectangular trihedrons with one another in the expanded position, and in that said first acute angle between the first and second edges of each link panel is a 45° angle and said second acute angle between the second edge of each link panel and the connection edge of the corresponding side wall is a 45° angle.

9. The self-expanding foldable structure according to claim 7, characterized in that each link panel is divided into two portions by a fold line, said fold line being oriented so that it or an imaginary prolongation thereof converges in said vertex.

10. The self-expanding foldable structure according to claim 6, characterized in that the shelf is hingedly joined at a first edge to said back wall.

11. The self-expanding foldable structure according to claim 6, characterized in that said shelf and said link panels are formed from a second sheet piece of a relatively rigid material selected from a group comprising cardboard, corrugated cardboard, plastic, corrugated plastic and foam board, wherein the hinged joints between said shelf and the link panels are fold lines.

12. The self-expanding foldable structure according to claim 11, characterized in that said second sheet piece comprises a first joining flange connected to a back edge of the shelf at a fold line and in the operative position it is adhered to an inner face of the back wall, and second joining flanges connected to the second edges of the link panels at respective fold lines and in the operative position they are adhered to the inner faces of the corresponding side walls.

13. The self-expanding foldable structure according to claim 12, characterized in that said elastic element is an elastic band connected at its ends to both of said two side walls below the shelf, and the second sheet piece comprises several additional portions connected to one another by fold lines, said additional portions including at least one flange or lower panel configured to at least partially conceal said elastic element.

14. The self-expanding foldable structure according to claim 13, characterized in that said additional portions of the second sheet piece include at least one reinforcement panel connected to a front edge of the shelf at a fold line, wherein said reinforcement panel and the shelf form a dihedron at least in the expanded position.

15. The self-expanding foldable structure according to claim 6, characterized in that said display rack comprises a pedestal formed by a lower shelf linked to the side walls by said link panels, a base panel with a back edge hingedly joined to a lower edge of the back wall, and a front wall with upper and lower edges hingedly joined to front edges of said lower shelf and of said base panel, respectively, wherein the base panel is parallel to the lower shelf and said front panel is parallel to the back wall.

16. The self-expanding foldable structure according to claim 15, characterized in that the lower shelf, the link panels, the base panel and the front panel are formed from a third sheet piece of a relatively rigid material selected from a group comprising cardboard, corrugated cardboard, plastic, corrugated plastic and foam board, wherein the hinges between the lower shelf and the link panels are fold lines, the hinge between the lower shelf and the front panel is a fold line, and the hinge between the front panel and the base panel is a fold line.

17. The self-expanding foldable structure according to claim 16, characterized in that said third sheet piece comprises a first joining flange connected to a back edge of the lower shelf at a fold line and in the operative position it is adhered to an inner face of the back wall, second joining flanges connected to the second edges of the link panels at respective fold lines and in the operative position they are adhered to the inner faces of the corresponding side walls, and a third joining flange connected to a back edge of the base panel at a fold line and in the operative position it is adhered to an inner face of the back wall.

18. The self-expanding foldable structure according to claim 1, characterized in that said elastic element is an elastic band connected at its ends to both of said two side walls.

19. The self-expanding foldable structure according to claim 1, characterized in that said back wall is a support and backing member, said side walls are support and armrest members, and said shelf is a seat of a self-expanding foldable display seat.

* * * * *